US010950106B2

(12) United States Patent
Slavin et al.

(10) Patent No.: US 10,950,106 B2
(45) Date of Patent: Mar. 16, 2021

(54) FIXED PROPERTY MONITORING WITH MOVING ASSET LOCATION TRACKING

(71) Applicant: Alarm.com Incorporated, Tysons, VA (US)

(72) Inventors: Alison Jane Slavin, Falls Church, VA (US); Jean-Paul Martin, Oakton, VA (US); Daniel J. Ramos, Arlington, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

(21) Appl. No.: 16/522,346

(22) Filed: Jul. 25, 2019

(65) Prior Publication Data

US 2020/0020216 A1 Jan. 16, 2020

Related U.S. Application Data

(63) Continuation of application No. 15/606,922, filed on May 26, 2017, now Pat. No. 10,366,588, which is a (Continued)

(51) Int. Cl.
*G08B 13/24* (2006.01)
*G08B 25/14* (2006.01)
(Continued)

(52) U.S. Cl.
CPC ..... *G08B 13/2462* (2013.01); *G08B 13/2402* (2013.01); *G08B 13/2491* (2013.01);
(Continued)

(58) Field of Classification Search
CPC .. G06Q 10/0631; G06Q 10/08; G06Q 10/087; G06Q 30/0609; G07C 5/0816; G08B 13/1418; G08B 13/1427; G08B 13/2402; G08B 13/2462; G08B 13/2491; G08B 21/0269; G08B 21/0283; G08B 21/0476; G08B 21/18; G08B 25/008; G08B 25/009; G08B 25/14; G08G 1/205; H04L 67/22; H04M 11/002; H04W 4/021; H04W 4/025; H04W 4/029
(Continued)

(56) References Cited

U.S. PATENT DOCUMENTS 4,743,892 A 5/1988 Zayle
5,781,108 A 7/1998 Jacob
(Continued)

OTHER PUBLICATIONS

U.S. Non-Final Office Action for U.S. Appl. No. 12/782,668 dated Aug. 29, 2012, 41 pages.
(Continued)

*Primary Examiner* — Stephen R Burgdorf
(74) *Attorney, Agent, or Firm* — Fish & Richardson P.C.

(57) ABSTRACT

Techniques are described for moving asset location tracking and monitoring system technology. A system monitors for events related to a monitoring system that monitors a fixed property and the system detects an event related to the monitoring system based on the monitoring. The system performs an operation that leverages geographic location tracking of at least one mobile asset associated with the fixed property based on the detected event.

19 Claims, 13 Drawing Sheets

Related U.S. Application Data continuation of application No. 14/814,090, filed on Jul. 30, 2015, now Pat. No. 9,666,047, which is a continuation of application No. 14/021,484, filed on Sep. 9, 2013, now Pat. No. 9,123,229, which is a continuation of application No. 12/782,668, filed on May 18, 2010, now Pat. No. 8,531,294.

(60) Provisional application No. 61/179,223, filed on May 18, 2009.

(51) Int. Cl.
*G08B 25/00* (2006.01)
*G08B 21/18* (2006.01)

(52) U.S. Cl.
CPC ..... *G08B 21/18* (2013.01); *G08B 25/008* (2013.01); *G08B 25/14* (2013.01)

(58) Field of Classification Search
USPC ..... 340/3.1, 539.13, 539.17, 541, 545.2, 340/568.1
See application file for complete search history.

(56) References Cited

U.S. PATENT DOCUMENTS 6,956,474 B2 10/2005 Jakubowski
7,113,090 B1 9/2006 Saylor et al.
7,190,264 B2 3/2007 Brown et al.
7,298,253 B2 11/2007 Petricoin et al.
7,460,883 B1 12/2008 McBrearty et al.
7,463,145 B2 12/2008 Jentoft
7,859,418 B2 12/2010 Greene
8,036,679 B1 10/2011 Barbeau et al.
8,350,694 B1 * 1/2013 Trundle ..... G08B 13/00 340/539.11
8,456,293 B1 6/2013 Trundle
8,531,294 B2 9/2013 Slavin et al.
8,798,613 B2 8/2014 MacNaughtan et al.
8,941,485 B1 1/2015 Mendelson
2001/0054952 A1 12/2001 Desai
2003/0200009 A1 * 10/2003 von Kannewurff .... G05B 15/02 700/275
2004/0030531 A1 2/2004 Miller et al.
2005/0068169 A1 3/2005 Copley et al.
2005/0285733 A1 12/2005 Gualdi et al.
2006/0099969 A1 5/2006 Staton et al.
2006/0238347 A1 10/2006 Parkinson et al.
2007/0063840 A1 3/2007 Jentoft
2007/0171046 A1 7/2007 Diem
2007/0210910 A1 9/2007 Norstrom et al.
2007/0247302 A1 10/2007 Martin
2007/0268849 A1 11/2007 Roy
2008/0001738 A1 1/2008 Super
2008/0061962 A1 3/2008 Campman
2008/0088437 A1 4/2008 Aninye et al.
2008/0094202 A1 4/2008 Martin
2008/0174485 A1 7/2008 Carani
2008/0284588 A1 11/2008 Kim et al.
2009/0043504 A1 * 2/2009 Bandyopadhyay .... G01C 21/16 701/469
2009/0124232 A1 5/2009 D'Arcy et al.
2009/0181640 A1 7/2009 Jones
2009/0184823 A1 7/2009 Tessier
2010/0148947 A1 6/2010 Morgan

OTHER PUBLICATIONS

U.S. Final Office Action for U.S. Appl. No. 12/782,668 dated Jan. 16, 2013, 50 pages.
U.S. Notice of Allowance for U.S. Appl. No. 12/782,668 dated Aug. 2, 2013, 12 pages.
U.S. Non-Final Office Action for U.S. Appl. No. 14/021,484 dated Jan. 15, 2014, 63 pages.
U.S. Non-Final Office Action for U.S. Appl. No. 14/021,484 dated Oct. 21, 2014, 52 pages.
U.S. Notice of Allowance for U.S. Appl. No. 14/021,484 dated Apr. 24, 2015, 10 pages.
Canada First Examination Report for Application No. 2,762,101 dated Feb. 11, 2016, 3 pages.

* cited by examiner

700

Son's Location Profile

7:00 AM – Wakes Up in Son's Bedroom
7:00 AM to 7:15 AM – In Son's Bedroom
7:15 AM to 7:30 AM – In Kitchen
7:30 AM – Leaves Home (with backpack and phone)
7:30 AM to 8:00 AM – Drives from Home to School (with backpack and phone)
8:00 AM to 4:00 PM – At School (with backpack and phone)
4:00 PM to 4:30 PM – Drives from School to Home (with backpack and phone)
4:30 PM – Returns Home (with backpack and phone)
4:30 PM to 5:00 PM – In Backyard
5:00 PM to 5:30 PM – In Basement
5:30 PM – Leaves Home (with phone, not backpack)
5:30 PM to 5:45 PM – Walks to Friend's House (with phone, not backpack)
5:45 PM to 6:30 PM – At Friend's House (with phone, not backpack)
6:30 PM to 6:45 PM – Walks Home (with phone, not backpack)
6:45 PM – Returns Home (with phone, not backpack)
6:45 PM to 8 PM – In Kitchen
8 PM to 10 PM – In Family Room
10 PM to 11:15 PM – In Son's Bedroom (Active)
11:15 PM – Detected as Sleeping in Son's Bedroom

FIG. 7

FIXED PROPERTY MONITORING WITH MOVING ASSET LOCATION TRACKING

CROSS REFERENCE TO RELATED APPLICATIONS

This application is a continuation of U.S. application Ser. No. 15/606,922, filed May 26, 2017, which is a continuation of U.S. application Ser. No. 14/814,090, filed Jul. 30, 2015, which is a continuation of U.S. application Ser. No. 14/021,484, filed Sep. 9, 2013, which is a continuation of U.S. application Ser. No. 12/782,668, filed May 18, 2010, which claims the benefit of U.S. Provisional Application No. 61/179,223, filed May 18, 2009. All of these prior applications are incorporated by reference in their entirety for all purposes.

TECHNICAL FIELD

This disclosure relates to moving asset location tracking and monitoring system technology.

BACKGROUND

Many people equip homes and businesses with alarm systems to provide increased security for their homes and businesses. Alarm systems may include control panels that a person may use to control operation of the alarm system and sensors that monitor for security breaches. In response to an alarm system detecting a security breach, the alarm system may generate an audible alert and, if the alarm system is monitored by a monitoring service, the alarm system may send electronic data to the monitoring service to alert the monitoring service of the security breach.

SUMMARY

Techniques are described for moving asset location tracking and monitoring system technology.

In one aspect, a system processes sensor data captured for a fixed property in combination with geographic location tracking data of one or more mobile assets associated with the fixed property. The system includes a monitoring system that is configured to monitor a fixed property and includes one or more sensors that are installed at the fixed property and that are configured to sense attributes of the fixed property. The system also includes one or more mobile devices that are configured to track and report geographic location data for one or more mobile assets associated with the fixed property and a monitoring application server that is configured to electronically receive, either directly or via a network communications module, data communications from the one or more sensors installed at the fixed property and receive data communications from the one or more mobile devices that are configured to track and report geographic location data. The monitoring application server is configured to perform operations. The operations include monitoring for events related to the monitoring system that monitors the fixed property, detecting an event related to the monitoring system that monitors the fixed property based on the monitoring; and, based on the detected event, performing an operation that involves geographic location tracking using the one or more mobile devices that are configured to track and report geographic location data for the one or more mobile assets associated with the fixed property.

Implementations may include one or more of the following features. For example, the operations may include determining, from among multiple possible user identities, an identity of a user associated with the detected event and controlling location tracking using the one or more mobile devices based on the determined identity. In this example, the operations may include initiating geographic location tracking of a mobile device assigned to track a mobile asset associated with the determined identity.

The operations also may include increasing frequency of geographic location tracking for a first mobile device assigned to track a first mobile asset associated with the determined identity and maintaining frequency of geographic location tracking for a second mobile device assigned to track a second mobile asset associated with an identity other than the determined identity. The second mobile device may be different from the first mobile device, the second mobile asset may be different from the first mobile asset, and the maintained frequency of geographic location tracking for the second mobile device may be lower than the increased frequency of geographic location tracking for the first mobile device. The operations further may include initiating monitoring of at least one of a geofence and an off-limit location defined for the determined identity.

In some examples, the operations may include detecting, based on data from a contact sensor that is included in the monitoring system and that senses whether a door or a window of the fixed property is oriented in an open or closed position, the user leaving the fixed property and determining an identity of the user associated with the door or the window of the fixed property through which the user exited. In these examples, the operations may include identifying a mobile device assigned to track a mobile asset associated with the determined identity and increasing frequency of geographic location tracking for the identified mobile device assigned to track the mobile asset associated with the determined identity.

In some implementations, the operations may include detecting, based on data from a contact sensor that is included in the monitoring system and that senses whether a door or a window of the fixed property is oriented in an open or closed position, the user leaving the fixed property and determining an identity of the user based on analysis of image data captured by a camera that is included in the monitoring system and that captures images of an area proximate to the door or the window of the fixed property through which the user exited. In these implementations, the operations may include identifying a mobile device assigned to track a mobile asset associated with the determined identity and increasing frequency of geographic location tracking for the identified mobile device assigned to track the mobile asset associated with the determined identity.

In addition, the operations may include detecting activity of a user within the fixed property, tracking the detected activity within the fixed property based on the detected activity, and combining the tracked activity data within the fixed property with location tracking data collected by a mobile device assigned to track a mobile asset associated with the user. The operations may include determining a location-based activity profile for the user using the combined tracked activity data and location tracking data and performing an operation that leverages the location-based activity profile for the user.

Further, the operations may include including, in the location-based activity profile, finer scale tracking data collected by the monitoring system when the user is detected as being located at the fixed property and including, in the location-based activity profile, larger scale tracking data collected by the mobile device assigned to track the mobile asset associated with the user when the user is detected as being away from the fixed property. The operations may include determining the location-based activity profile for the user using location tracking data collected by each of multiple mobile devices assigned to track multiple mobile assets associated with the user and including, in the location-based activity profile, an indication of which of the multiple mobile assets associated with the user is tracked.

Also, the operations may include determining a location of the user based on the location-based activity profile for the user and sending, to another user, a notification that includes the location of the user determined based on the location-based activity profile for the user.

The operations may include accessing geographic location tracking data for at least one mobile asset associated with the fixed property. The geographic location tracking data may be tracked by at least one of the one or more mobile devices. The operations also may include controlling an operation related to the monitoring system based on the detected event and the accessed geographic location tracking data.

In some examples, the operations may include detecting an event that triggers consideration of whether an automatic control operation for the monitoring system should be performed and determining whether to perform the automatic control operation for the monitoring system based on the accessed geographic location tracking data. In these examples, the operations may include causing performance of the automatic control operation for the monitoring system in response to a determination to perform the automatic control operation for the monitoring system and maintaining a state of the monitoring system without causing performance of the automatic control operation for the monitoring system in response to a determination not to perform the automatic control operation for the monitoring system.

In some implementations, the operations may include detecting an absence of activity within the fixed property while the monitoring system is in a disarmed state that triggers consideration of whether the monitoring system should be automatically set to an armed state in which a security alarm is generated in response to detected entry into the fixed property and determining whether at least one user associated with the fixed property is within a threshold distance of the fixed property based on the accessed geographic location tracking data. In these implementations, the operations may include determining to maintain the monitoring system in the disarmed state in response to a determination that at least one user associated with the fixed property is within the threshold distance of the fixed property and determining to automatically set the monitoring system to the armed state in response to a determination that at least one user associated with the fixed property is not within the threshold distance of the fixed property. Further, in these implementations, the operations may include automatically, without human intervention, setting the monitoring system to the armed state in response to a determination to automatically set the monitoring system to the armed state and maintaining the monitoring system in the disarmed state in response to a determination to maintain the monitoring system in the disarmed state.

In addition, the operations may include detecting a request from a user to perform a control operation for the monitoring system and determining whether to perform the requested control operation for the monitoring system based on the accessed geographic location tracking data. In response to a determination to perform the requested control operation for the monitoring system, the operations may include causing performance of the requested control operation for the monitoring system. In response to a determination not to perform the requested control operation for the monitoring system, the operations may include denying the request from the user to perform the control operation for the monitoring system.

In some examples, the operations may include detecting a request from the user to disarm the monitoring system from an armed state in which a security alarm is generated in response to detected entry into the fixed property. In these examples, the operations may include determining a geographic location of the user based on the accessed geographic location tracking data and determining whether the user is within a threshold distance of the fixed property based on the determined geographic location of the user. Also, in these examples, the operations may include determining to grant the request from the user to disarm the monitoring system in response to a determination that the user is within the threshold distance of the fixed property and determining to deny the request from the user to disarm the monitoring system in response to a determination that the user is outside of the threshold distance of the fixed property. Further, in these examples, the operations may include disarming the monitoring system in response to a determination to grant the request from the user to disarm the monitoring system and, in response to a determination to deny the request from the user to disarm the monitoring system, maintaining the monitoring system in the armed state and sending a message to the user to indicate that the request to disarm the monitoring system has been denied.

In addition, the operations may include detecting an alarm condition at the fixed property based on data from the monitoring system and generating an alarm notification that includes a description of the alarm condition detected at the fixed property and an identification of a geographic location of at least a first user associated with the fixed property. The operations may include sending the generated alarm notification to a second user associated with the fixed property, the second user being different from the first user.

Further, the operations may include detecting an event at the fixed property related to a notification rule that defines conditions for sending a notification in response to detection of the event. The operations may include evaluating the notification rule in light of the accessed geographic location tracking data and handling the notification based on results of evaluating the notification rule in light of the accessed geographic location tracking data.

In some implementations, the operations may include detecting an event at the fixed property related to a notification rule that defines conditions for selecting one or more recipients of the notification and determining a geographic location for each of multiple, possible recipients of the notification based on the accessed geographic location tracking data. In these implementations, the operations may include analyzing the determined geographic location for each of multiple, possible recipients of the notification with respect to the conditions for selecting one or more recipients of the notification defined by the notification rule and selecting a subset of the multiple, possible recipients of the notification based on the analysis. In these implementations, the operations may include sending the notification to the selected subset of the multiple, possible recipients.

In some examples, the operations may include detecting an event at the fixed property related to a notification rule that defines conditions for determining whether or not to send the notification and determining a geographic location for at least one possible recipient of the notification based on the accessed geographic location tracking data. In these examples, the operations may include analyzing the determined geographic location for the at least one possible recipient of the notification with respect to the conditions for determining whether or not to send the notification defined by the notification rule and determining whether or not to send the notification to the at least one possible recipient based on the analysis. In these examples, the operations may include sending the notification to the at least one possible recipient in response to a determination to send the notification to the at least one possible recipient, and withholding the notification from the at least one possible recipient in response to a determination not to send the notification to the at least one possible recipient.

Implementations of the described techniques may include hardware, a method or process implemented at least partially in hardware, or a computer-readable storage medium encoded with executable instructions that, when executed by a processor, perform operations.

The details of one or more implementations are set forth in the accompanying drawings and the description below. Other features will be apparent from the description and drawings, and from the claims.

DESCRIPTION OF DRAWINGS

FIG. 7 illustrates an example location-based activity profile.

DETAILED DESCRIPTION

Techniques are described for providing moving asset location tracking. In some implementations, a native mobile device application enables use of a mobile device to observe and provide alerts related to the location of assets (e.g., car, trailer, motorcycle, boat, ATV, Tractor, Kid's Backpack, Grandma's Purse, etc.). The native mobile device application combines a data feed from a security/sensor network installed in a fixed location, such as a home or business, and the location data provided by moving assets for more intelligent tracking, reporting and alerting.

Figure 1:
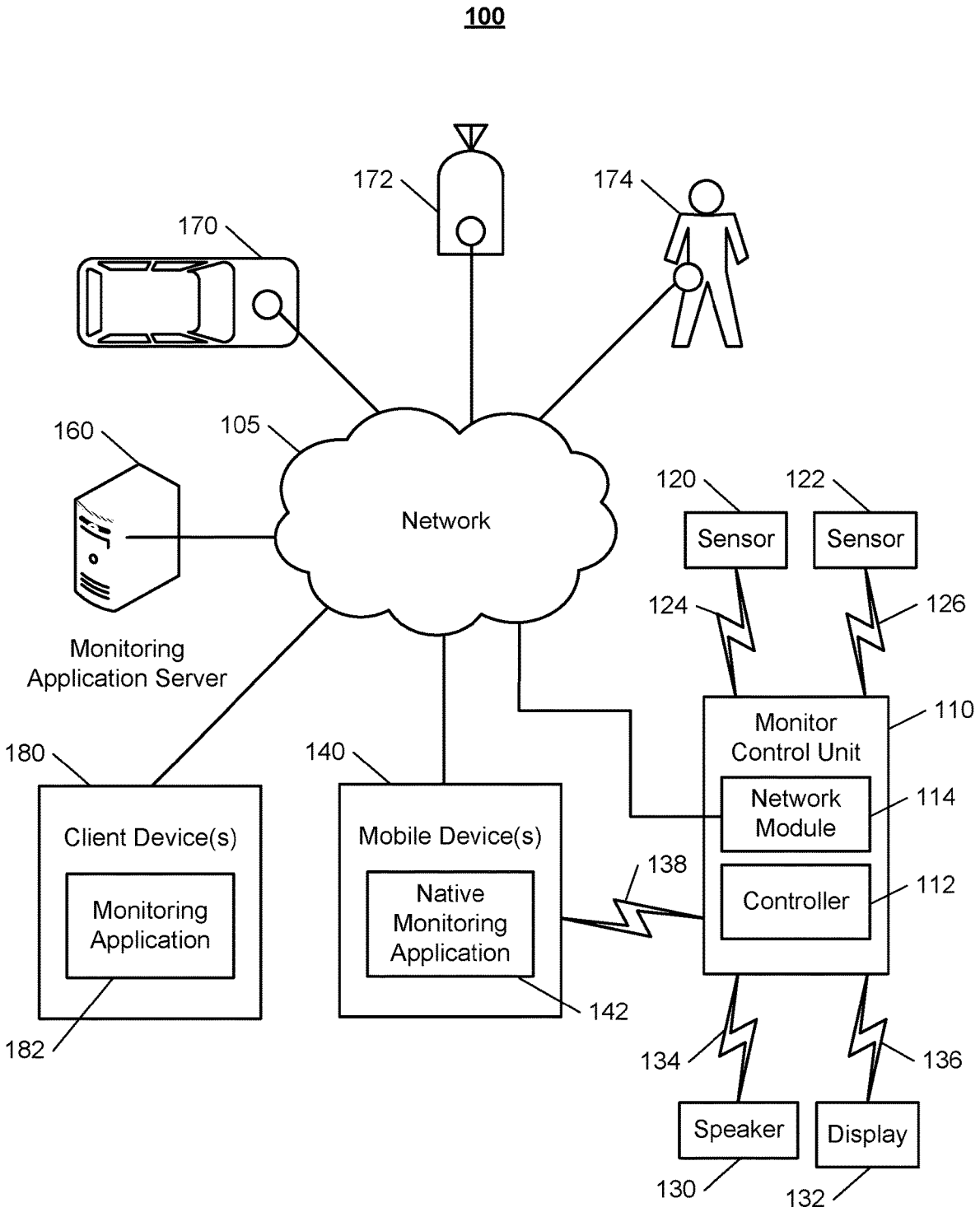
FIG. 1 is a block diagram of an example system.

FIG. 1 illustrates an example of an electronic system 100 configured to provide moving asset location tracking using one or more mobile devices. The electronic system 100 includes a network 105, a monitoring system control unit 110, one or more mobile devices 140, a monitoring application server 160, moving assets 170-174, and one or more client devices 180. In some examples, the network 105 facilitates communications between the monitoring system control unit 110, the one or more mobile devices 140, the monitoring application server 160, the moving assets 170-174, and the one or more client devices 180.

The network 105 is configured to enable exchange of electronic communications between devices connected to the network 105. For example, the network 105 may be configured to enable exchange of electronic communications between the monitoring system control unit 110, the one or more mobile devices 140, the monitoring application server 160, the central alarm station server 170, and the one or more client devices 180. The network 105 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 105 may include multiple networks or subnetworks, each of which may include, for example, a wired or wireless data pathway. The network 105 may include a circuit-switched network, a packet-switched data network, or any other network able to carry electronic communications (e.g., data or voice communications). For example, the network 105 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 105 may include one or more networks that include wireless data channels and wireless voice channels. The network 105 may be a wireless network, a broadband network, or a combination of networks including a wireless network and a broadband network.

The monitoring system control unit 110 includes a controller 112 and a network module 114. The controller 112 is configured to control a monitoring system (e.g., a home alarm or security system) that includes the monitoring system control unit 110. In some examples, the controller 112 may include a processor or other control circuitry configured to execute instructions of a program that controls operation of an alarm system. In these examples, the controller 112 may be configured to receive input from sensors, detectors, or other devices included in the alarm system and control operations of devices included in the alarm system or other household devices (e.g., a thermostat, an appliance, lights, etc.). For example, the controller 112 may be configured to control operation of the network module 114 included in the monitoring system control unit 110.

The network module 114 is a communication device configured to exchange communications over the network 105. The network module 114 may be a wireless communication module configured to exchange wireless communications over the network 105. For example, the network module 114 may be a wireless communication device configured to exchange communications over a wireless data channel and a wireless voice channel. In this example, the network module 114 may transmit alarm data over a wireless data channel and establish a two-way voice communication session over a wireless voice channel. The wireless communication device may include one or more of a GSM module, a radio modem, cellular transmission module, or any type of module configured to exchange communications in one of the following formats: GSM or GPRS, CDMA, EDGE or EGPRS, EV-DO or EVDO, UMTS, or IP.

The network module 114 also may be a wired communication module configured to exchange communications over the network 105 using a wired connection. For instance, the network module 114 may be a modem, a network interface card, or another type of network interface device. The network module 114 may be an Ethernet network card configured to enable the monitoring system control unit 110 to communicate over a local area network and/or the Internet. The network module 114 also may be a voiceband modem configured to enable the alarm panel to communicate over the telephone lines of Plain Old Telephone Systems (POTS).

The monitoring system that includes the monitoring system control unit 110 includes one or more sensors or detectors. For example, an alarm system may include multiple sensors 120 and 122. The sensors 120 and 122 may include a contact sensor, a motion sensor, a glass break sensor, or any other type of sensor included in an alarm system or security system. The sensors 120 and 122 also may include an environmental sensor, such as a temperature sensor, a water sensor, a rain sensor, a wind sensor, a light sensor, a smoke detector, a carbon monoxide detector, an air quality sensor, etc. The sensors 120 and 122 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 120 and 122 may include a radio-frequency identification (RFID) sensor that identifies a particular article that includes a pre-assigned RFID tag. In addition, the sensors 120 and 122 may include a video/photographic camera or other type of optical sensing device configured to capture images and may include an energy consumption sensor for appliances and devices in a property monitored by the monitoring system.

The sensors 120 and 122 communicate with the controller 112 over communication links 124 and 126. The communication links 124 and 126 may be a wired or wireless data pathway configured to transmit signals from the sensors 120 and 122 to the controller 112. The sensors 120 and 122 may continuously transmit sensed values to the controller 112, periodically transmit sensed values to the controller 112, or transmit sensed values to the controller 112 in response to a change in a sensed value.

The controller 112 may receive signals from the sensors 120 and 122 and detect an alarm event based on the sensed values. For example, the sensor 120 may be a contact sensor provided on a door to a residence and the communication link 124 may be a wireless connection between the sensor 120 and the controller 112. In this example, the sensor 120 may sense that the door has been opened (e.g., absence of a connection between contacts included as part of the sensor) and wirelessly transmit data over communication link 124 to the controller 112 indicating that the door has been opened. The controller 112 receives the data from the sensor 120 over the communication link 124 and determines that an alarm event (e.g., the door opened) has occurred based on the signal from the sensor 120. The controller 112 controls operation of the alarm system based on the determination that the alarm event has occurred.

The monitoring system also includes a speaker 130. The speaker 130 may include an electromechanical transducer that converts an electrical signal into sound. The speaker 130 may receive an electrical signal from the controller 112 and produce an audible output based on the electrical signal. For example, the controller 112, in response to detecting an alarm event, may send a signal to the speaker 130 to cause the speaker to produce an audible alarm sound. The speaker 130 also may output audio messages (e.g., audio advertisements, broadcast audio alerts, etc.). In another example, the controller 112 may send a signal representative of a voice communication to the speaker 130 to cause the speaker to produce an audible output of the voice communication.

The monitoring system also includes a display 132. The display 132 may be any type of electronic display configured to render a visually perceivable display of information (e.g., an LCD display, a plasma display, a television, a computer monitor, a digital picture frame, a display integrated into an appliance, a display included in a portable device of a user, a mirror, a projection display device, etc.). The display 132 may be integrated in the monitoring system control unit 110 (e.g., control panel) or may be separate from the monitoring system control unit 110 (e.g., a separate display provided as part of the security system or a television, a computer monitor, etc. that is not part of the security system, but a device with which the security system may communicate). The display 132 may be used to depict the current state of the monitoring system. For example, an LCD display may display words like "System Disarmed 6:42 pm", or "Enter User Code to Disarm", or "Front Door Opened". The display 132 also may be used to display electronic content, such as advertisement content, news content, weather content, and entertainment content.

The monitoring system control unit 110 communicates with the speaker 130 and the display 132 over communication links 134 and 136. The communication links 134 and 136 may be similar to the communication links 124 and 126 described above.

The monitoring application server 160 is an electronic device configured to provide monitoring services by exchanging electronic communications with the monitoring system control unit 110, the one or more mobile devices 140, and the one or more client devices 180 over the network 105. For example, the monitoring application server 160 may be configured to monitor events generated by the monitoring system control unit 110. In this example, the monitoring application server 160 may exchange electronic communications with the network module 114 included in the monitoring system control unit 110 to receive information regarding alarm events detected by the monitoring system control unit 110. Additionally or alternatively, the monitoring application server 160 may receive information regarding events from the one or more mobile devices 140 or the one or more client devices 180.

The monitoring application server 160 may store sensor (e.g., moving asset locations) data received from the monitoring system and perform analysis of sensor data received from the monitoring system. Based on the analysis, the monitoring application server 160 may communicate with and control aspects of the monitoring system control unit 110, the one or more mobile devices 140, or the one or more client devices 180.

The one or more mobile devices 140 are devices that host and display user interfaces and that host one or more native applications (e.g., the native monitoring application 142). The one or more mobile devices 140 may be cellular phones or non-cellular locally networked devices with displays. The one or more mobile devices 140 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The one or more mobile devices 140 may be the same or may include mobile devices of different types. The one or more mobile devices 140 may perform functions unrelated to the monitoring system, such as placing personal telephone calls, playing music, playing video, displaying pictures, browsing the Internet, maintaining an electronic calendar, etc.

The one or more mobile devices 140 communicate with and receive monitoring system data from the monitoring system control unit 110 using the communication link 138. For instance, the one or more mobile devices 140 may communicate with the monitoring system control unit 110 using various local wireless protocols such as wifi, Bluetooth, zwave, zigbee, HomePlug (ethernet over powerline), or wired protocols such as Ethernet and USB, to connect the one or more mobile devices 140 to local security and automation equipment. The one or more mobile devices 140 may connect locally to the monitoring system and its sensors and other devices. The local connection may improve the speed of status and control communications because communicating through the network 105 with a remote server (e.g., the monitoring application server 160) may be significantly slower.

Although the one or more mobile devices 140 are shown as communicating with the monitoring system control unit 110, the one or more mobile devices 140 may communicate directly with the sensors and other devices controlled by the monitoring system control unit 110. In some implementations, the one or more mobile devices 140 replace the monitoring system control unit 110 and perform the functions of the monitoring system control unit 110 for local monitoring and long range/offsite communication.

In other implementations, the one or more mobile devices 140 receive monitoring system data captured by the monitoring system control unit 110 through the network 105. The one or more mobile devices 140 may receive the data from the monitoring system control unit 110 through the network 105 or the monitoring application server 160 may relay data received from the monitoring system control unit 110 to the one or more mobile devices 140 through the network 105. In this regard, the monitoring application server 160 may facilitate communication between the one or more mobile devices 140 and the monitoring system.

In some implementations, the one or more mobile devices 140 may be configured to switch whether the one or more mobile devices 140 communicate with the monitoring system control unit 110 directly (e.g., through link 138) or through the monitoring application server 160 (e.g., through network 105) based on a location of the one or more mobile devices 140. For instance, when the one or more mobile devices 140 are located close to the monitoring system control unit 110 and in range to communicate directly with the monitoring system control unit 110, the one or more mobile devices 140 use direct communication. When the one or more mobile devices 140 are located far from the monitoring system control unit 110 and not in range to communicate directly with the monitoring system control unit 110, the one or more mobile devices 140 use communication through the monitoring application server 160 to communicate with the monitoring system control unit 110.

Although the one or more mobile devices 140 are shown as being connected to the network 105, in some implementations, the one or more mobile devices 140 are not connected to the network 105. In these implementations, the one or more mobile devices 140 communicate directly with one or more of the monitoring system components and no network (e.g., Internet) connection or reliance on remote servers is needed.

The one or more mobile devices 140 each include a native monitoring application 142. The native monitoring application 142 refers to a software/firmware program running on the corresponding mobile device that enables the user interface and features described below. The one or more mobile devices 140 may load or install the native monitoring application 142 based on data received over a network or data received from local media. The native monitoring application 142 runs on mobile devices platforms, such as iPhone, iPod touch, Blackberry, Google Android, Windows Mobile, etc.

The system 100 also includes moving assets 170-174. The moving assets 170-174 are each outfitted with a device that reports location remotely back to the native monitoring application 142, using long-range communication protocols such as cellular (CDMA, GSM, LTE, etc.), WiMax, satellite, etc., or through local or mesh networks, such as wifi, zigbee, zwave, Bluetooth, etc. As shown, the moving asset 170 is a car, the moving asset 172 is a bag, and the moving asset 174 is a person. Other types of moving assets may be monitored and moving assets may include any objects that may be moved and tracked. Although FIG. 1 illustrates three moving assets, actual implementations may include more (and, perhaps, many more) or fewer moving assets.

The native monitoring application 142 enables a user to perceive the location of the moving assets 170-174 using the one or more mobile devices 140 in real time. The native monitoring application 142 also tracks the mobile device's physical location using GPS and/or other location protocols built into mobile device. The native monitoring application 142 shows the current location of the moving assets 170-174 and its current location on a visual map displayed by the native monitoring application 142. The visual map may be interactive and respond to user input. The native monitoring application 142 provides access to the multiple moving assets through a single interface.

In some implementations, the native monitoring application 142 enables users to create and modify allowed geographic areas (geofences) through the native monitoring application 142. The native monitoring application 142 provides an alert (e.g., email/text alerts) when one or more of the moving assets 170-174 goes outside of the allowed geographic area ("geofence").

The native monitoring application 142 also may create trigger locations. For instance, if one or more of the moving assets 170-174 gets within a threshold distance of a trigger location ("off-limit locations"), the native monitoring application 142 provides an alert (e.g., email/text alerts). An "off-limit" location may be a defined geographic area or a type of location. For example, the native monitoring application 142 may define a portion of a town that a parent user considers to be a bad part of town as an "off-limit" location for a car of a teenager and provide the parent user with an alert when the car of the teenager enters the bad part of town. In another example, the native monitoring application 142 may define highways as an "off-limit" location for a car of a teenager because a parent user believes highways are unsafe for teenage drivers. In this example, the native monitoring application 142 provides the parent user with an alert when the car of the teenager enters any highway.

In some examples, the native monitoring application 142 monitors the current location of the mobile device relative to the location of the moving assets 170-174. For instance, the native monitoring application 142 computes a relative distance between the changing location of the mobile device and changing locations of the moving assets 170-174 and, when the relative distance is less than (or more than) a threshold, the native monitoring application 142 provides an alert (e.g., email/text alerts). As one example, when a parent's mobile device is within a threshold distance of the moving asset 172 tracking a child's bag, the native monitoring application 142 provides an alert to the parent and/or the child that an opportunity to meet exists. As another example, when a parent's mobile device becomes more than a threshold distance away from the moving asset 172 tracking a child's bag, the native monitoring application 142 provides an alert to the parent that the child has moved away from the parent and the parent may need to take action.

The native monitoring application 142 may operate geofences and off-limit locations on a schedule. The size and location of geofences and off-limit locations may change based on time of day (e.g., a moving asset may be allowed to move further from home during the daytime than during the nighttime). In addition, whether geofences and off-limit locations are treated as non-alarm or alarm alerts may change based on time of day (e.g., an off-limit event during the daytime may trigger a non-alarm event, whereas the same off-limit event during the nighttime may trigger an alarm event). Further, the native monitoring application 142 may use scheduled location reporting to show moving asset location at various times in the day and later plot a path on a map through the native monitoring application 142 (e.g., moving asset automatically reports coordinates every X minutes throughout day).

In some implementations, the native monitoring application 142 combines a data feed from a security/sensor network installed in a fixed location, such as the home or business, and the location data provided by the moving assets 170-174, for more intelligent tracking, reporting and alerting. For example, the native monitoring application 142 may receive security/sensor data from the monitoring system control unit 110 over the communication link 138 or may receive security/sensor data from the monitoring application sever 160. In this example, the native monitoring application 142 may analyze the security/sensor data received from the monitoring system control unit 110 or the monitoring application sever 160 in combination with data from the moving assets 170-174 in performing tracking operations.

For instance, when the native monitoring application 142 receives data indicating that a person (e.g., Grandma, teenager, Nanny with the kids, etc.) has been detected leaving the house, the native monitoring application 142 starts tracking where the moving asset 170 (i.e., car) is going. When the native monitoring application 142 receives data indicating that the person has been detected getting back home, the native monitoring application 142 uploads a "route report" of where the moving asset 170 (i.e., car) went. If the native monitoring application 142 receives data indicating that a home alarm has gone off signaling a security breach, the native monitoring application 142 determines whether the moving assets 170-174 are nearby or not and may be able to assist in handling the home alarm. Also, the native monitoring application 142 (or the monitoring application server 160) may store location information and use the stored location information to determine where the moving assets were last located prior to the home alarm.

In some examples, users of a security system have unique codes and the security system is able to determine which of multiple users has armed or disarmed the system. The native monitoring application 142 may leverage the identification of the user in tracking location of the moving assets. For instance, when a child user uses the child's code to arm the security system and then leaves the house, the native monitoring application 142 begins tracking moving assets associated with the child user (e.g., the child's backpack, etc.).

The native monitoring application 142 also may increase tracking frequency based on security system events. For example, the native monitoring application 142 may track at home (or stationary) assets at a first frequency. When the asset leaves the home (or begins to move), the native monitoring application 142 may track the asset at a second frequency that is faster than the first frequency. Because the native monitoring application 142 modifies frequency of tracking based on need, the native monitoring application 142 may conserve its own power, as well as the power of the devices tracking the location of the moving assets 170-174.

The native monitoring application 142 also may implement a permission system that provides a different level of control for different users. For instance, parent users may have full control of the monitoring system and a child user may have limited control (e.g., the child user may be able to see some moving assets, but not others). The permission system may be implemented based on user-specific passcodes or particular mobile devices may be assigned to particular users.

In implementations in which multiple mobile devices are included in the system 100, the native monitoring application 142 may include rules that govern input from which of the multiple devices controls when conflicting input is received. For instance, when a parent user is attempting to perform a first action and a child user is attempting to perform a second, different action that conflicts with the first action, the rules of the native monitoring application 142 (or monitoring system in general) may perform the first action only because the parent user has higher priority than the child user.

The one or more client devices 180 may be any type of client devices (e.g., personal computers) that are capable of performing operations similar to those described as being performed by the one or more mobile devices 140. The one or more client devices 180 operate a monitoring application 182 either locally or over a network. The monitoring application 182 may be similar to the native monitoring application 142 operated by the one or more mobile devices 140.

FIGS. 2, 4, 6, and 9 illustrate example processes. The operations of the example processes are described generally as being performed by the system 100. The operations of the example processes may be performed by one of the components of the system 100 (e.g., the monitoring application server 160) or may be performed by any combination of the components of the system 100. In some implementations, operations of the example processes may be performed by one or more processors included in one or more electronic devices.

Figure 2:
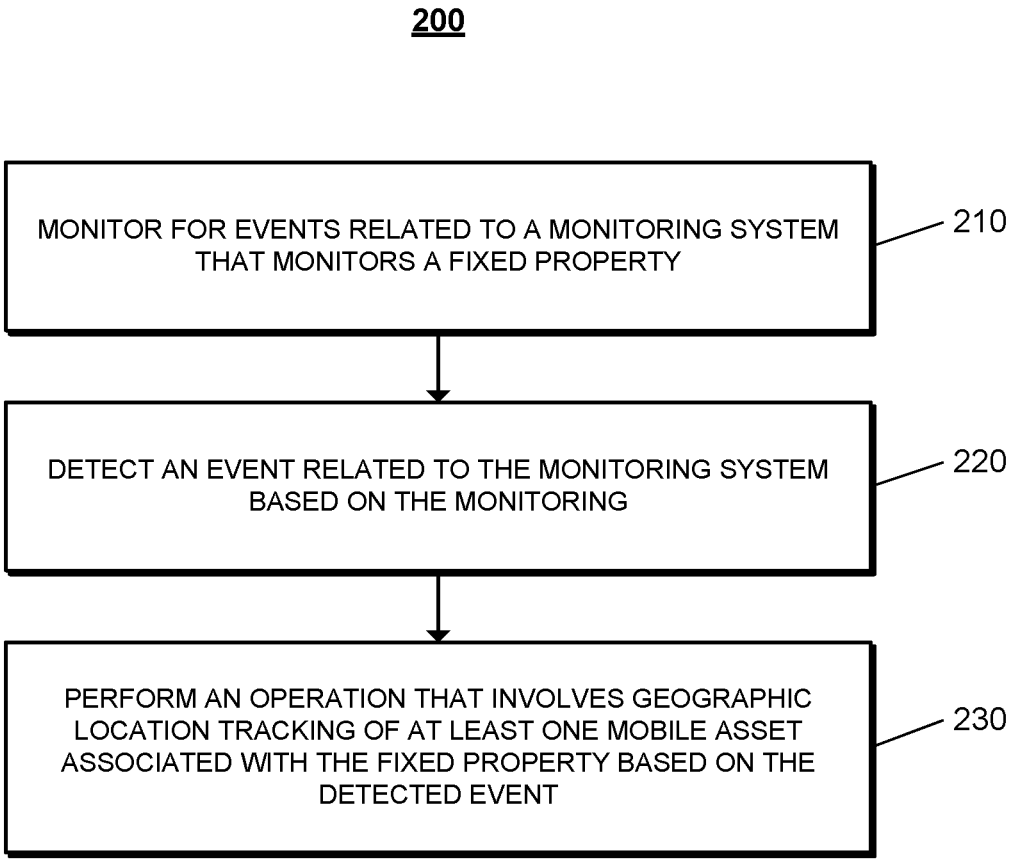
FIGS. 2, 4, 6, and 9 are flow charts illustrating example processes.

FIG. 2 illustrates an example process 200 for performing an operation that leverages geographic location tracking of at least one mobile asset associated with a fixed property based on an event detected by a monitoring system that monitors the fixed property. The system 100 monitors for events related to a monitoring system that monitors a fixed property (210). For example, the system 100 receives, either directly or via a network, data communications from sensors included in a monitoring system that are configured to sense physical attributes of the physical world at the fixed property. The sensor data may include presence monitoring events, such as contact sensor data captured by door and/or window sensors, motion sensor data captured by a motion sensor, and image monitoring data captured by a camera. The sensor data also may include environmental sensor data (e.g., temperature sensor data, air quality sensor data, water sensor data, etc.), health monitoring sensor data (e.g., blood sugar monitors, blood pressure monitors, etc.), radio frequency identification (RFID) sensor data (e.g., RFID tags may be applied to articles (e.g., a car or a prescription bottle) and RFID sensors may detect presence of the articles), or any other sensor data related to physical attributes capable of being monitored using sensor technology.

The system 100 may monitor the received sensor data for single detected events (e.g., a single contact sensor trigger) or a series of detected events (e.g., a pattern of contact sensor triggers, a motion sensor trigger, and an RFID tag identification). In addition, the sensor data may be direct data captured by the sensors or may be processed prior to being received by the system 100. The sensor data may processed by performing statistical calculations on the sensor data to identify trends within the data (e.g., based on sensor data captured during typical work days, a customer leaves the home through the front door on average at 8:26 am and enters the home through the front door on average at 5:38 pm).

In some implementations, the system 100 may monitor user input provided to control the monitoring system for the fixed property. In these implementations, the system 100 may detect a request from a user to perform a control operation for the monitoring system as an event. A request to perform a control operation may include a request to arm or disarm the monitoring system, a request to receive data captured by the monitoring system (e.g., sensor data, video data, etc.), or any type of request that involves controlling the monitoring system to output data or change settings.

The system 100 detects an event related to the monitoring system based on the monitoring (220). For instance, the system 100 may detect an alarm condition (e.g., a security breach) at the fixed property. The system 100 also may detect a notification event that triggers consideration of whether a notification should be sent based on attributes sensed at the fixed property. The system 100 further may detect requests to control the monitoring system as events. The system 100 may detect single events (e.g., a single contact sensor trigger) or detect a series or pattern of events (e.g., a pattern of contact sensor triggers, a motion sensor trigger, and an RFID tag identification).

The system 100 performs an operation that involves geographic location tracking of at least one mobile asset associated with the fixed property based on the detected event (230). For example, the system 100 may control geographic location tracking operations performed using one or more mobile devices that are configured to track and report geographic location data for one or more mobile assets associated with the fixed property. In this example, the system 200 may increase frequency of (e.g., initiate) geographic location tracking based on detecting an event. In this regard, the system 100 may start geographic location tracking when the system 100 detects a user exiting the fixed property based on sensor data from the monitoring system that monitors the fixed property.

In some implementations, the system 100 performs operations related to the monitoring system that monitors the fixed property based on geographic location tracking data tracked by one or more mobile devices that are configured to track and report geographic location data for one or more mobile assets associated with the fixed property. In these implementations, the system 100 may handle sending of notifications generated in response to detected events based on geographic location tracking data. The system 100 also may control functionality of the monitoring system based on geographic location tracking data. For instance, the system 100 may determine whether or not to perform automatic control operations for the monitoring system based on geographic location tracking data and/or may determine whether or not to perform requested control operations for the monitoring system based on geographic location tracking data.

Figure 3:
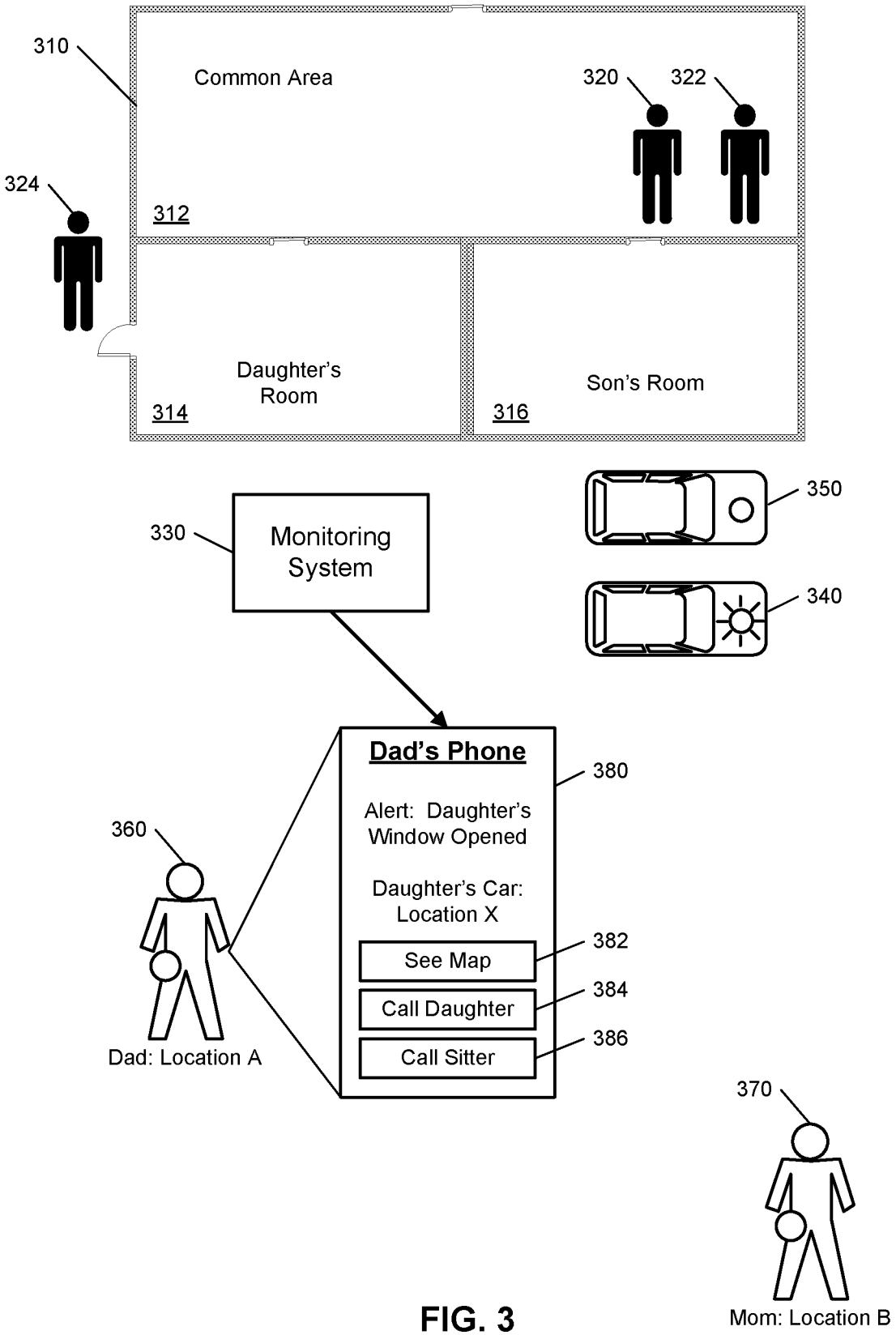
FIG. 3 illustrates an example of performing an operation that involves geographic location tracking of at least one mobile asset associated with a fixed property based on an event detected by a monitoring system that monitors the fixed property.

FIG. 3 illustrates an example of performing an operation that involves geographic location tracking of at least one mobile asset associated with a fixed property based on an event detected by a monitoring system that monitors the fixed property. As shown, a fixed property 310 (e.g., a home residence) includes a common area 312, a daughter's room 314, and a son's room 316. In the example shown in FIG. 3, a babysitter 320 and a son 322 are located in the common area 312 and a daughter 324 has opened a window in the daughter's room 314 and exited the fixed property 310.

A monitoring system 330 monitors events in the fixed property 310 based on data from sensors that monitor attributes of the fixed property 310. When the daughter 324 opens the window in the daughter's room 314 and exits the fixed property 310, the monitoring system 330 detects the opening of the window in the daughter's room 314 based on output from a contact sensor located at the window in the daughter's room 314 and infers that the daughter 324 has exited the fixed property 310 through the window.

In some implementations, the monitoring system 330 may attempt to confirm whether the daughter 324 has, in fact, exited the building through the window by analyzing motion sensor data sensed by one or more motion sensors located at the fixed property 310 and/or by analyzing image data captured by one or more cameras located at the fixed property 310. In these implementations, the monitoring system 330 may attempt to confirm whether the daughter 324 has exited the building by analyzing motion sensor data proximate to the daughter's room 314 to detect whether a person remains present in the area proximate to the daughter's room 314. The monitoring system 330 also may analyze the image data to determine whether a person having biometric characteristics that match the daughter 324 remains in the fixed property 310.

In response to the detection of the opening of the window in the daughter's room 314 and the inference that the daughter 324 has exited the fixed property 310 through the window, the monitoring system 330 performs operations that involve geographic location tracking of at least one mobile asset associated with the fixed property 310. For example, the monitoring system 330 initiates tracking of mobile assets associated with the daughter 324 to track geographic movement of the daughter 324 to the extent possible. In this regard, the monitoring system 330 initiates a mobile device that tracks a geographic location of the daughter's car 340. The monitoring system 330 does not initiate a mobile device that tracks a geographic location of the son's car 350 because the monitoring system 330 has not detected an event that suggests the son 322 leaving the property 310 or has confirmed through sensor data that the son 322 remains in the property 310.

The monitoring system 330 also evaluates a notification rule that controls sending of a notification related to the detected opening of the daughter's window. In this example, the notification rule defines a dad 360 and a mom 370 as possible recipients of the notification and also defines certain geographic criteria related to the location of the dad 360 and the mom 370 for handling the notification. To evaluate the geographic criteria, the monitoring system 330 determines a location of the dad 360 based on data from a mobile device that tracks a moving asset assigned to the dad 360 and determines a location of the mom 370 based on data from a mobile device that tracks a moving asset assigned to the mom 370. In this regard, the monitoring system 330 determines that the dad 360 is currently at location A and the mom 370 is currently at location B. The monitoring system 330 evaluates the determined geographic locations of the dad 360 and the mom 370 and determines to send a notification to only the dad 360 based on the determined geographic locations.

In some implementations, the geographic criteria defined by the notification rule may define that the notification should be sent to the possible recipient that is closest to the detected event or closest to the user associated with the detected event (i.e., the daughter 324 in this case). In these implementations, the monitoring system 330 determines that the location of the dad 360 is closer to the detected event (or the location of the daughter 324) than the location of the mom 370. Because the location of the dad 360 is closer, the monitoring system 330 sends the notification to the dad 360, rather than the mom 370.

In some examples, the geographic criteria defined by the notification rule may define that the notification should be sent to possible recipients that are within a threshold distance of the detected event or the user associated with the detected event (i.e., the daughter 324 in this case). In these examples, the monitoring system 330 determines that the location of the dad 360 is within the threshold distance to the detected event (or the location of the daughter 324) and the location of the mom 370 is not within the threshold distance to the detected event (or the location of the daughter 324). Because the location of the dad 360 is within the threshold distance and the location of the mom 370 is outside of the threshold distance, the monitoring system 330 sends the notification to the dad 360, but not the mom 370. Had the mom 370 been within the threshold distance, the monitoring system 330 may have sent the notification to both the dad 360 and the mom 370. Had the dad 360 been outside of the threshold distance, the monitoring system 330 may have decided not to send a notification or may have sent the notification to both the dad 360 and the mom 370.

Based on the notification being sent by the monitoring system 330 to the dad 360, the dad 360 receives the notification of his mobile phone 380. As shown, the notification includes a description of the event that triggered the notification (i.e., Daughter's Window Opened) and an indication of a location of a moving asset associated with the daughter 324 (i.e., Location X). The monitoring system 330 may identify the geographic location of the daughter's car 340 to include it in the notification based on the initiation of the mobile device that tracks the geographic location of the daughter's car 340.

The notification also includes a "See Map" input control 382, a "Call Daughter" input control 384, and a "Call Sitter" input control 386. The "See Map" input control 382 causes the mobile phone 380 to display a map that tracks a location of moving assets associated with the daughter 324. The displayed map may allow the dad 360 to track a location of the daughter 324 in real time and determine what actions the daughter 324 is taking. The "Call Daughter" input control 384 causes the mobile phone 380 to initiate a call to the daughter 324 and the "Call Sitter" input control 386 causes the mobile phone 380 to initiate a call to the babysitter 320. The input controls may be included in the notification to assist the dad 360 in quickly assessing and handling the situation resulting in the notification.

Figure 4:
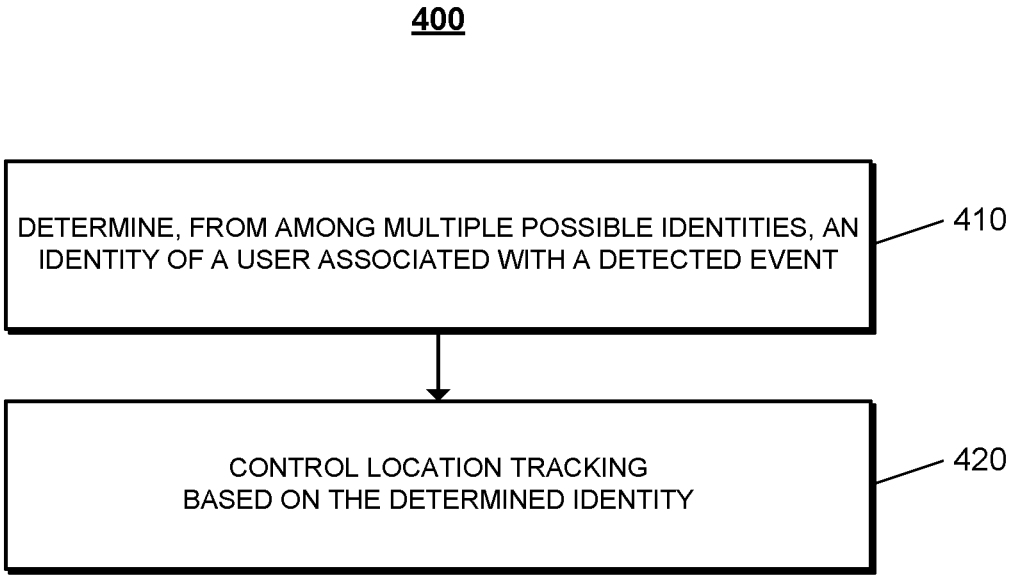

FIG. 4 illustrates an example process 400 for controlling location tracking based on a determined identity of a user associated with an event detected by a monitoring system. The system 100 determines, from among multiple possible identities, an identity of a user associated with a detected event (410). The system 100 may use any technique to determine a user identity of a user. For example, when the detected event relates to presence within a property, the system 100 may analyze image data of the property in an attempt to determine an identity of the user that is present in the property. In this example, the system 100 may process the image data using facial or body type recognition techniques to identify an identity of the user. The system 100 may use other types of biometric data (e.g., fingerprint scans) to identify a user.

In another example, when the detected event relates to arming or disarming of a security system, the system 100 may determine an identity of the user based on a user-specific code used to arm or disarm the security system. In this example, the system 100 may assign different codes to different users and detect user identity by determining the identity assigned to the code entered to arm or disarm the security system.

In some implementations, the system 100 may determine an identity of the user based on which sensors in a property have been triggered. For instance, the system 100 may determine that a first user is in the property when a door sensor on the first user's bedroom detects a door opening and may determine that a second user is in the property when a door sensor on the second user's bedroom detects a door opening.

The system 200 also may determine multiple user identities when multiple users are associated with an event. For example, when multiple users are within a property, the system 200 may determine a user identity for each of the multiple users.

The system 100 controls location tracking based on the determined identity (420). For example, the system 100 may identify a mobile device assigned to track a mobile asset associated with the determined identity and initiate geographic location tracking of the mobile device assigned to track the mobile asset associated with the determined identity. In this example, the system 100 may turn on the mobile device assigned to track the mobile asset associated with the determined identity and begin logging geographic locations and corresponding times based on location reports received from the mobile device.

In some examples, the system 100 may increase frequency of geographic location tracking for a first mobile device assigned to track a first mobile asset associated with the determined identity and maintain frequency of geographic location tracking for a second mobile device assigned to track a second mobile asset associated with an identity other than the determined identity. In these examples, the maintained frequency of geographic location tracking for the second mobile device may be lower than the increased frequency of geographic location tracking for the first mobile device. The increase in frequency may include causing the first mobile device to report its location more frequently (e.g., from not reporting to reporting or from reporting at a low rate to reporting at a high rate). The second mobile device may be maintained in a state where it does not report its location, or does so at a low rate.

In some implementations, the system 100 may initiate monitoring of a geofence and/or an off-limit location defined for the determined identity based on the detecting the event. In these implementations, the system 100 may be receiving geographic location data from a mobile device assigned to track a mobile asset associated with the determined identity, but may only be logging the received geographic location data without performing any processing. After the event has been detected, the system 100 may start processing the received geographic location data to determine whether the user moves outside of a geofence that defines a permissible area in which the user is allowed to travel and an alert is needed. The system 100 also may start processing the received geographic location data to determine whether the user is approaching an off-limit location that defines an area in which the user is not permitted to travel and an alert is needed.

Figure 5:
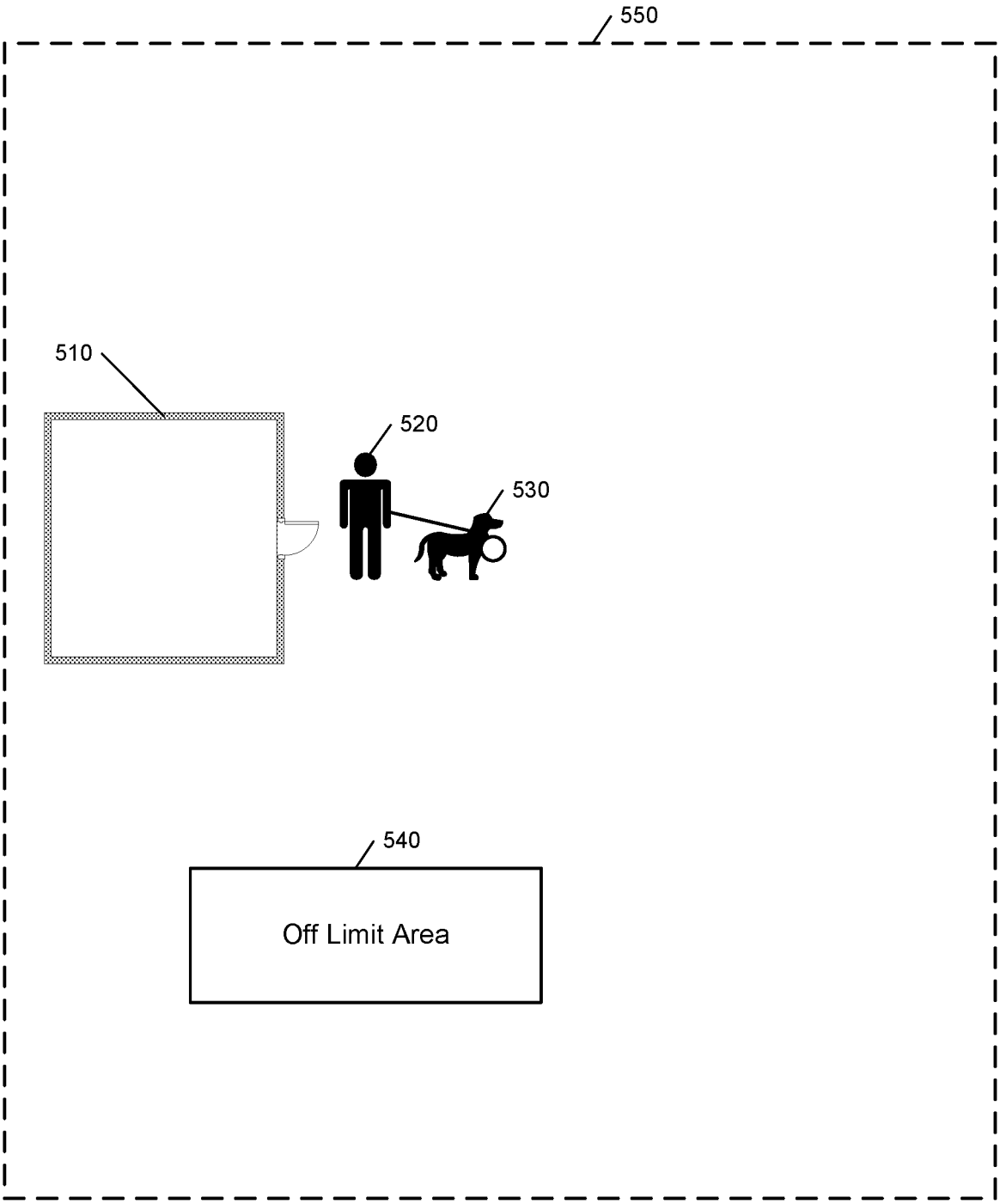
FIG. 5 illustrates an example of controlling location tracking based on a determined identity of a user associated with an event detected by a monitoring system.

FIG. 5 illustrates an example of controlling location tracking based on a determined identity of a user associated with an event detected by a monitoring system. In the example shown in FIG. 5, a monitoring system monitors a fixed property 510 and the monitoring system detects opening of a front door of the fixed property 510 based on a door contact sensor located at the front door. In response to detecting opening of the front door of the fixed property 510, the monitoring system analyzes image data that covers an area proximate to the front door just prior to the front door being opened and determines that the front door opening event is associated with a dog walker 520 and a dog 530. Based on the determination that the front opening event is associated with the dog walker 520 and the dog 530, the monitoring system determines that the dog walker 520 is taking the dog 530 for a walk and begins processing geographic location data for the dog 530. Had the monitoring system determined that the front opening event was associated with only the dog walker 520, the monitoring system may not have begun processing geographic location data for the dog 530.

The monitoring system processes geographic location data for the dog 530 by increasing a frequency at which a mobile device (e.g., located on a collar of the dog 530) assigned to track a location of the dog 530 reports its geographic location and starts evaluating the received geographic location data for the dog 530 against an off-limit area 540 defined for the dog 530 and a geofence 550 defined for the dog 530. The off-limit area 540 defines an area in which the dog walker 520 is not permitted to walk the dog 530. The owner of the dog 530 may define the off-limit area 540 because the off-limit area 540 may be dangerous for the dog 530 (e.g., because of presence of another potentially vicious dog) or because the off-limit area 540 does not permit dog walking. The monitoring system may send an alert to the owner of the dog 530 when the monitoring system detects a geographic location of the dog 530 approaching or entering the off-limit area 540.

The geofence 550 defines an area in which the dog walker 520 is permitted to walk the dog 530. The owner of the dog 530 may define the geofence 550 because the owner wants to limit the area in which the dog walker 520 takes the dog 530 in an effort to protect the health and safety of the dog 530. The monitoring system may send an alert to the owner of the dog 530 when the monitoring system detects a geographic location of the dog 530 moving outside of the geofence 550.

Because the monitoring system begins processing geographic location data for the dog 530 only after the monitoring system detected the dog walker 520 and the dog 530 exiting the property 510 through the front door, the monitoring system is able to conserve energy and processing power for both itself and the mobile device that tracks a location of the dog 530. Specifically, the mobile device that tracks a location of the dog 530 conserves power because it only reports its location at an increased frequency when geographic location tracking is relevant and being processed. In addition, the monitoring system conserves power because it only processes geographic location data for the dog 530 when geographic location tracking is relevant.

Figure 6:
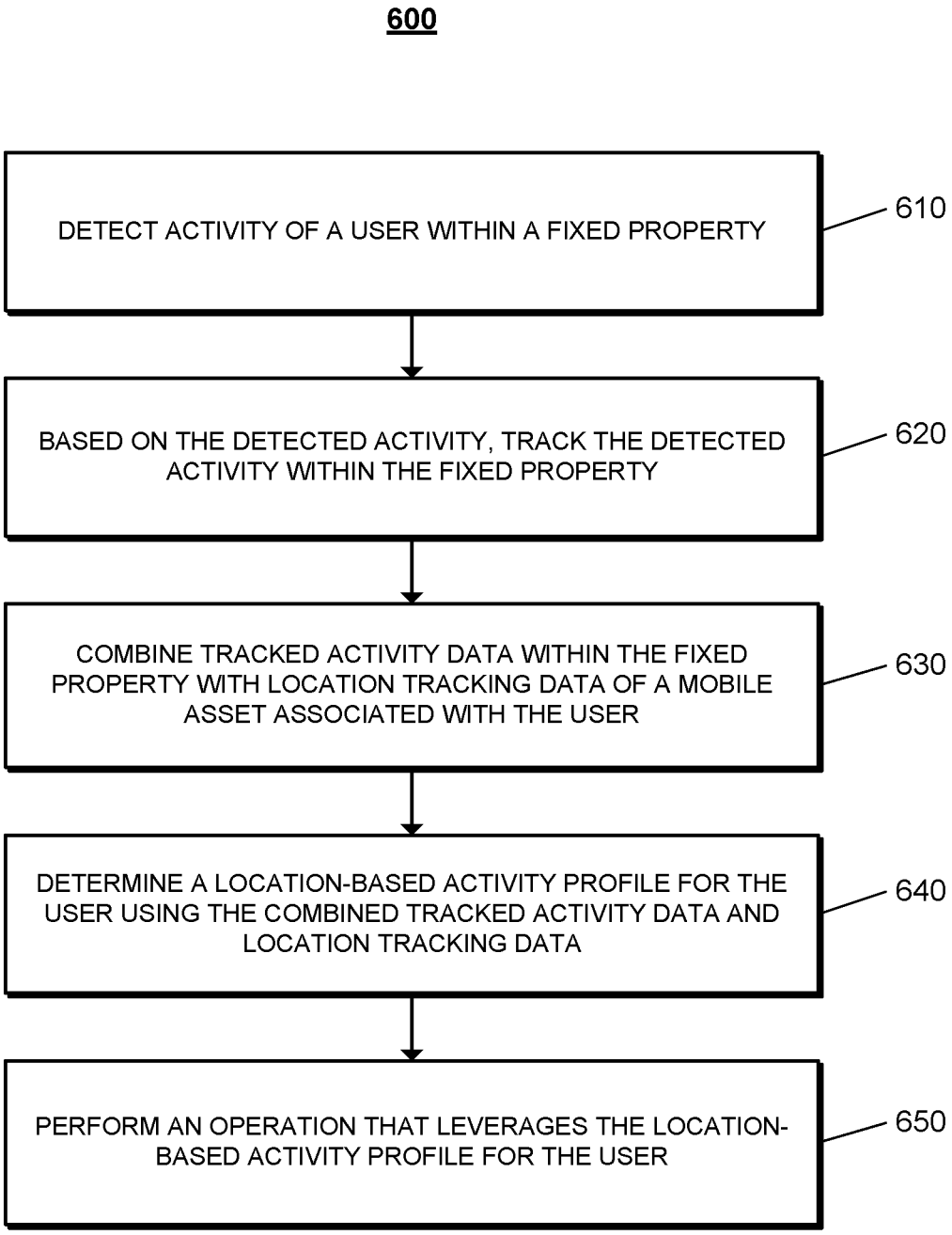

FIG. 6 illustrates an example process 600 for performing an operation that leverages a location-based activity profile. The system 100 detects activity of a user within a fixed property (610). For example, the system 100 may monitor sensor data captured by a monitoring system and detect a user entering or exiting a property based on the sensor data. In this example, the system 100 may detect a user entering or exiting a property based on any combination of door contact sensors for doors to the property, motion sensors that monitor motion within the property, and image sensors that capture images within the property.

When the system 100 detects the user entering the property, the system 100 monitors sensor data captured by the monitoring system to detect activity (e.g., presence) of the user within the property. When the system 100 detects the user exiting the property, the system 100 monitors devices tracking one or more moving assets associated with the user to attempt to determine the user's movements outside of the property. The system 100 may use any of the techniques described throughout this disclosure (or other techniques) to determine an identity of the user and associate the detected activity with the identified user.

The system 100 tracks the detected activity within the fixed property based on the detected activity (620). For instance, the system 100 monitors the user's movements throughout the property based on sensor data captured by the monitoring system at the property and logs the user's movements within the property.

The system 100 combines tracked activity data within the fixed property with location tracking data of a mobile asset associated with the user (630) and determines a location-based activity profile for the user using the combined tracked activity data and location tracking data (640). For example, the system 100 integrates, in storage, the tracked activity data within the fixed property with location tracking data of a mobile asset associated with the user. In this example, the system 100 processes the stored data and derives a location-based activity profile for the user that includes both the tracked activity data within the fixed property and the geographic location tracking data from the mobile asset associated with the user.

The location-based activity profile includes data describing the user's location throughout a course of a day and attempts to include location data for all parts of the day. In determining the location-based activity profile, the system 100 uses the tracked activity data within the fixed property for time periods when the user is detected by the system 100 as being located at the fixed property and uses the geographic location tracking data for time periods when the user is detected by the system 100 as being located away from the fixed property.

The tracked activity data within the fixed property represents finer scale tracking data collected by local sensors included in a monitoring system that monitors the fixed property. The geographic location tracking data represents larger scale tracking data collected by the mobile device assigned to track the mobile asset associated with the user when user is detected as being away from the fixed property. The tracked activity data within the fixed property is at a finer scale because the tracked activity data within the fixed property is able to determine which room a user occupies within the fixed property and the geographic location tracking data gives an absolute location of a moving asset associated with the user, which may not provide as specific of a location as the tracked activity data. Also, the tracked activity data within the fixed property tracks the actual movements of the user, whereas the geographic location tracking data tracks the location of a mobile asset associated with the user, which the user may not be in position of at all times when the user moves throughout the fixed property.

In some implementations, the system 100 determines the location-based activity profile using location tracking data collected by each of multiple mobile devices assigned to track multiple mobile assets associated with the user. In these implementations, the system 100 may differentiate, in the location-based activity profile, location data tracked by each of the multiple mobile devices. In this regard, the system 100 may include, in the location-based activity profile, an indication of which of the multiple mobile assets associated with the user is tracked and which of the multiple mobile assets are in possession of the user throughout a day.

An example location-based activity profile is shown in FIG. 7. The example location-based activity profile is described in more detail below.

The system 100 performs an operation that leverages the location-based activity profile for the user (650). For example, the system 100 may store and/or display the location-based activity profile for the user. In this example, the system 100 may display the location-based activity profile to the user, so that the user can retrace his or her movements throughout a particular time period (e.g., a day). This may be helpful to the user when the user has misplaced an item and the user would like to retrace his or her movements in an attempt to locate the misplaced item. The system 100 also may display the location-based activity profile to another user, such as a parent when the user is a child. This may be helpful to the parent because the parent is able to observe the child's movement and ensure the child is safe and attending the activities (e.g., school) the child tells the parent the child is attending.

In some examples, the system 100 may determine a location of the user based on the location-based activity profile for the user. In these examples, the determined location may be more specific when the user is located within the property (e.g., in the family room or in the basement) as compared to when the user is away from the property (e.g., at school or at a friend's house). In these examples, the system 100 may use the determined location for any of the purposes in which a determined location is used throughout this disclosure. For instance, the system 100 may send, to another user, a notification that includes the location of the user determined based on the location-based activity profile for the user.

FIG. 7 illustrates an example location-based activity profile 700. The example location-based activity profile 700 is determined for a son between the hours of seven in the morning to eleven fifteen in the evening while the son is awake. The example location-based activity profile 700 is determined based on data collected by a monitoring (e.g., security) system at the son's house, location data reported by the son's mobile phone, and location data reported by a mobile device that is secured to the son's backpack and that determines and reports its location.

As shown, the location-based activity profile 700 indicates that the monitoring system detected the son waking up in the son's bedroom at seven in the morning. The monitoring system also detected the son in the son's bedroom between seven and seven fifteen, and detected the son in the kitchen between seven fifteen and seven thirty. The monitoring system further detected the son leaving the home at seven thirty and, at that time, tracking of the son's mobile phone and the mobile device secured to the son's backpack was initiated. The son's mobile phone and the son's backpack were detected as being in the son's possession when the son was detected as leaving the home.

The son's mobile phone and the mobile device secured to the son's backpack detected the son driving from home to school between seven thirty and eight and remaining at school from eight in the morning to four in the afternoon. The son's mobile phone and the mobile device secured to the son's backpack detected the son driving from school to home between four and four thirty. The monitoring system detected the son entering the home at four thirty, detected the son in the backyard from four thirty to five, and detected the son in the basement from five to five thirty. The monitoring system also detected the son leaving the home at five thirty and, at that time, tracking of the son's mobile phone and the mobile device secured to the son's backpack was initiated. The son's mobile phone was detected as being in the son's possession when the son was detected as leaving the home, but the son's backpack was not detected as being in the son's possession when the son was detected as leaving the home. This information may be useful to the son's parents because it shows the son was not in possession of his backpack and, therefore, was unlikely doing school work during the time the son was away from the home.

The son's mobile phone detected the son walking from home to a friend's house between five thirty and five forty-five. Driving and walking may be differentiated within location-based activity profile 700 based on the speed of movement tracked for the moving assets. Driving and walking also may be differentiated within location-based activity profile 700 based on data from a device that tracks location of the son's car in addition to the son's mobile phone.

The son's mobile phone detected the son at the friend's house between five forty-five and six thirty and detected the son walking home from the friend's house between six thirty and six forty-five. The monitoring system detected the son entering the home at six forty-five, detected the son in the kitchen from six forty-five to eight, and detected the son in the family room from eight to ten. The monitoring system also detected the son being active in the son's bedroom from ten to eleven fifteen and detected the son falling asleep in the son's bedroom at eleven fifteen. The monitoring system may detect the son falling asleep based on the light in the son's bedroom being turned off, the son being detected as getting into bed, and/or no motion being detected in the son's bedroom. As shown in FIG. 7, the location-based activity profile 700 provides a detailed account of the son's movements throughout the day, with more-detailed information being provided for time periods in which the son was located at the property monitored by the monitoring system.

Figure 8:
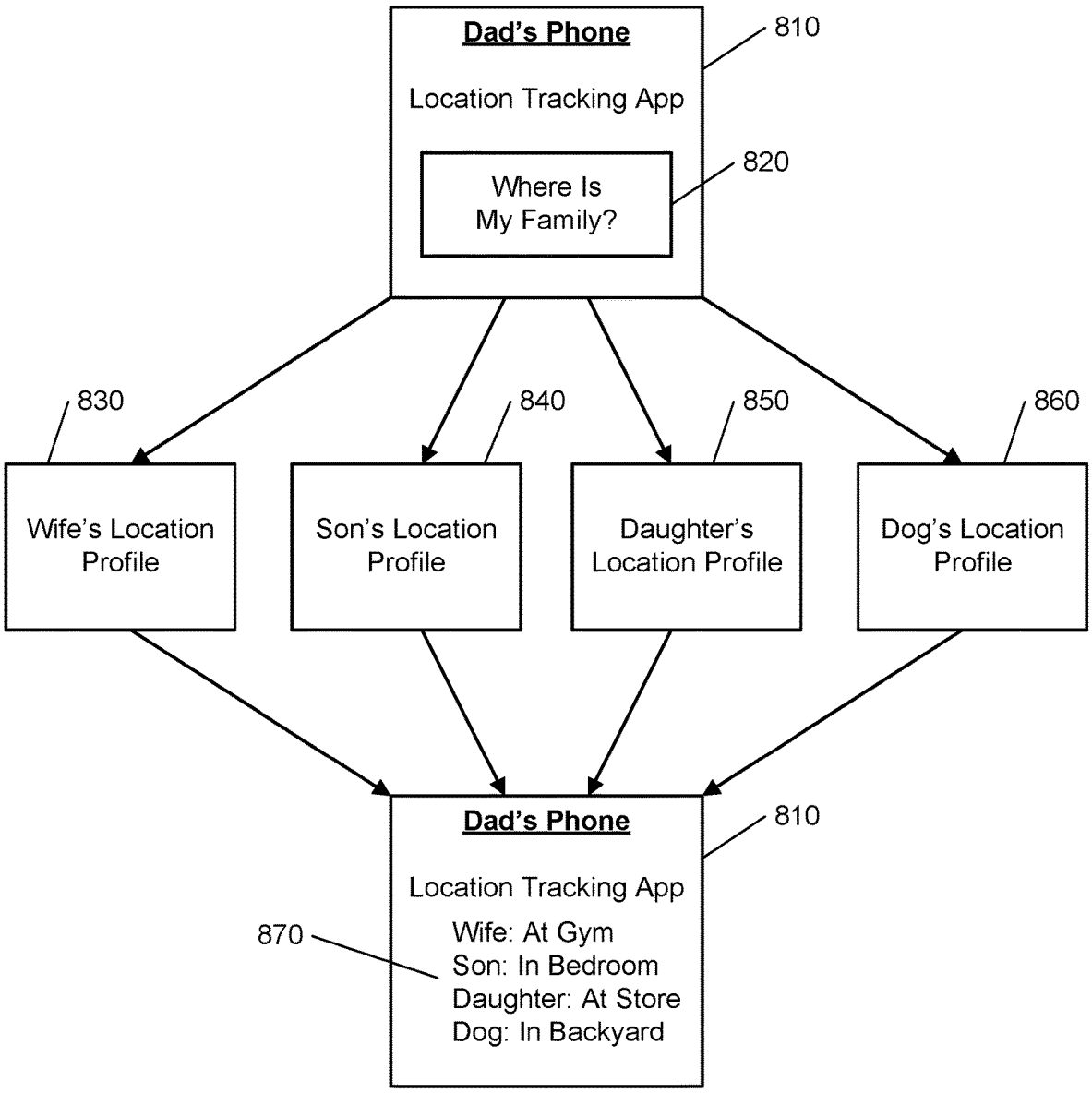
FIG. 8 illustrates an example of performing an operation that leverages location-based activity profiles.

FIG. 8 illustrates an example of performing an operation that leverages location-based activity profiles. As shown, a location tracking application is being run on a mobile phone 810 of a dad. The dad may initiate the location tracking application when the dad is interested in finding out location information for members of the dad's family. For example, the dad may return home from work to what appears to be an empty house and initiate the location tracking application to determine where members of the dad's family are located.

The location tracking application displays an input control 820 that, when activated, initiates a process to determine and display location information for each user defined as being part of the dad's family. When the input control 820 is activated, the users defined as being part of the dad's family are identified and a location-based activity profile is accessed for each of the identified users. For instance, as shown, a first profile 830 is accessed for the wife, a second profile 840 is accessed for the son, a third profile 850 is accessed for the daughter, and a fourth profile 860 is accessed for the dog. The first profile 830 is used to determine the current location of the wife, the second profile 840 is used to determine the current location of the daughter, the third profile 850 is used to determine the current location of the son, and the fourth profile 860 is used to determine the current location of the dog.

The mobile phone 810 receives location data from the profiles 830-860 and displays the location of each member of the dad's family in a location display area 870. The mobile phone 810 may receive the profiles 830-860 and derive the current locations from the profiles or may simply receive the current locations already derived from the profiles 830-860.

As shown, the location display area 870 indicates that the wife is at the gym, the son is in his bedroom, the daughter is at the store, and the dog is in the backyard. Based on the location information shown in the location display area 870, the dad is able to quickly understand the location of all member's of his family, which may be helpful to ease the dad's peace of mind and to help the dad determine what he would like to do. For instance, the dad learns that the son is in his bedroom although the house appeared to be empty and, therefore, may decide to walk to the son's bedroom to interact with his son. Getting this detailed information about the son's location may be helpful to the dad because he does not have to yell throughout the home or search multiple locations to determine whether anyone is home.

Figure 9:
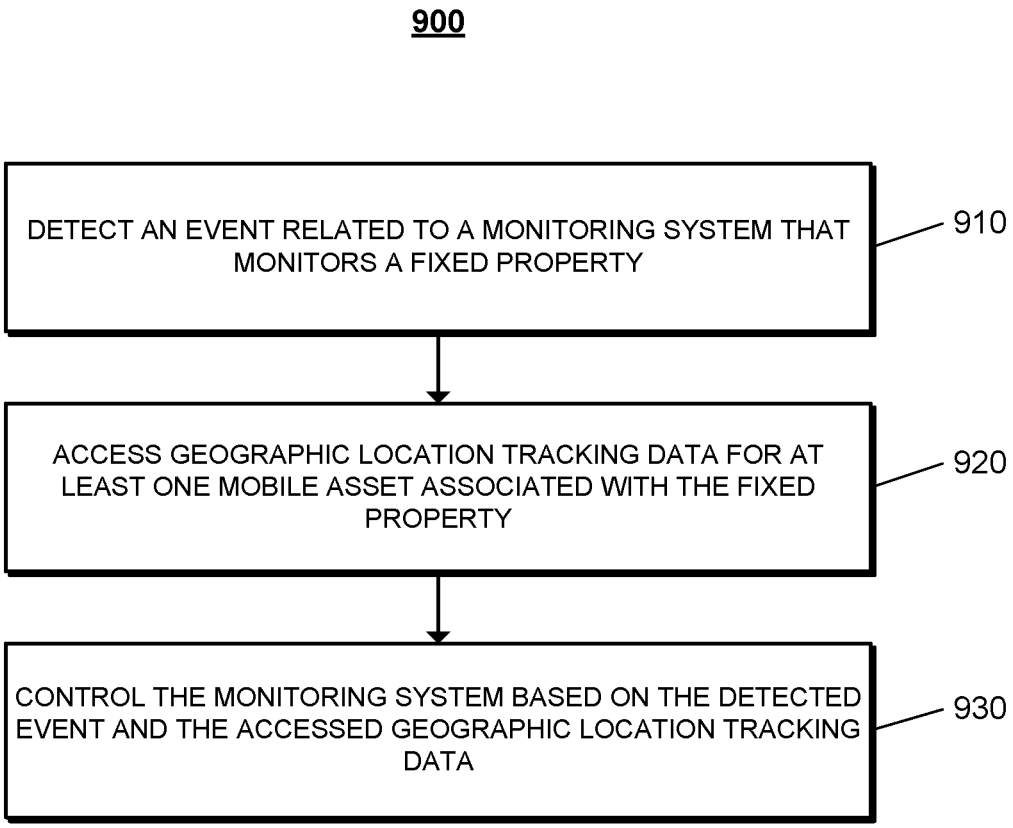

FIG. 9 illustrates an example process 900 for controlling a monitoring system based on a detected event and accessed geographic location tracking data. The system 100 detects an event related to a monitoring system that monitors a fixed property (910). For instance, the system 100 may use techniques similar to those described above with respect to reference numeral 220 to detect an event related to a monitoring system that monitors a fixed property.

The system 100 accesses geographic location tracking data for at least one mobile asset associated with the fixed property (920). For example, the system 100 may access, from electronic storage, geographic location tracking data for one or more mobile assets associated with the fixed property. In this example, the system 100 may access, from a log of geographic locations, recent entries (e.g., the most recent entry) for geographic locations tracked for the one or more mobile assets.

The system 100 also may receive geographic location tracking data from one or more mobile devices that track geographic location for one or more mobile assets associated with the fixed property. For instance, the system 100 may ping each of the one or more mobile devices that track geographic location for the one or more mobile assets to report its location in response to detecting the event related to the monitoring system.

The system 100 controls the monitoring system based on the detected event and the accessed geographic location tracking data (930). For instance, the system 100 may automatically, without human intervention, control the monitoring system based on the detected event and the accessed geographic location tracking data. The system 100 also may control sending of notifications related to the detected event based on the detected event and the accessed geographic location tracking data. The system 100 further may handle (e.g., accept or deny) requests to control the monitoring system based on the detected event and the accessed geographic location tracking data.

In some examples, the system 100 may detect an event that triggers consideration of whether an automatic control operation for the monitoring system should be performed. In these examples, the system 100 may determine whether to perform the automatic control operation for the monitoring system based on the accessed geographic location tracking data. In response to a determination to perform the automatic control operation for the monitoring system, the system 100 may cause performance of the automatic control operation for the monitoring system and, in response to a determination not to perform the automatic control operation for the monitoring system, the system 100 may maintain a state of the monitoring system without causing performance of the automatic control operation for the monitoring system.

For instance, the system 100 may detect an absence of activity within the fixed property while the monitoring system is in a disarmed state. This may trigger consideration of whether the monitoring system should be automatically set to an armed state in which a security alarm is generated in response to detected entry into the fixed property. The system 100 may determine whether at least one user associated with the fixed property is within a threshold distance of the fixed property based on the accessed geographic location tracking data. In response to a determination that at least one user associated with the fixed property is within the threshold distance of the fixed property, the system 100 may maintain the monitoring system in the disarmed state and, in response to a determination that at least one user associated with the fixed property is not within the threshold distance of the fixed property, the system 100 may automatically, without human intervention, set the monitoring system to the armed state.

In some implementations, the system 100 may detect a request from a user to perform a control operation for the monitoring system and determine whether to perform the requested control operation for the monitoring system based on the accessed geographic location tracking data. For example, the system 100 may detect a request from the user to disarm the monitoring system from an armed state in which a security alarm is generated in response to detected entry into the fixed property, determine a geographic location of the user based on the accessed geographic location tracking data, and determine whether the user is within a threshold distance of the fixed property based on the determined geographic location of the user. In response to a determination that the user is within the threshold distance of the fixed property, the system 100 may disarm the monitoring system and, in response to a determination that the user is outside of the threshold distance of the fixed property, the system 100 may maintain the monitoring system in the armed state and send a message to the user to indicate that the request to disarm the monitoring system has been denied.

In some examples, the system 100 may detect an alarm condition (e.g., security breach, fire alarm, severe weather event, terrorist attack, etc.) at the fixed property based on data from the monitoring system and generate an alarm notification that includes a description of the alarm condition detected at the fixed property and an identification of a geographic location of one or more users associated with the fixed property. In these examples, the system 100 sends the generated alarm notification to a user associated with the fixed property, so that the user may perceive the location of other users associated with the fixed property at the time of the alarm condition.

In some implementations, the system 100 may detect an event at the fixed property related to a notification rule that defines conditions for sending a notification in response to detection of the event. In these implementations, the system 100 may evaluate the notification rule in light of the accessed geographic location tracking data and handle the notification based on results of evaluating the notification rule in light of the accessed geographic location tracking data. For example, the notification rule may define conditions for selecting one or more recipients of the notification and the system 100 may select a subset of multiple, possible recipients of the notification based on an analysis of geographic locations determined for the multiple, possible recipients of the notification and the conditions defined by the notification rule. In this example, the system 100 sends the notification to the selected subset of the multiple, possible recipients. In another example, the notification rule may define conditions for determining whether or not to send the notification and the system 100 may determine whether or not to send the notification to a possible recipient based on an analysis of a geographic location determined for the possible recipient and the conditions defined by the notification rule.

Figure 10:
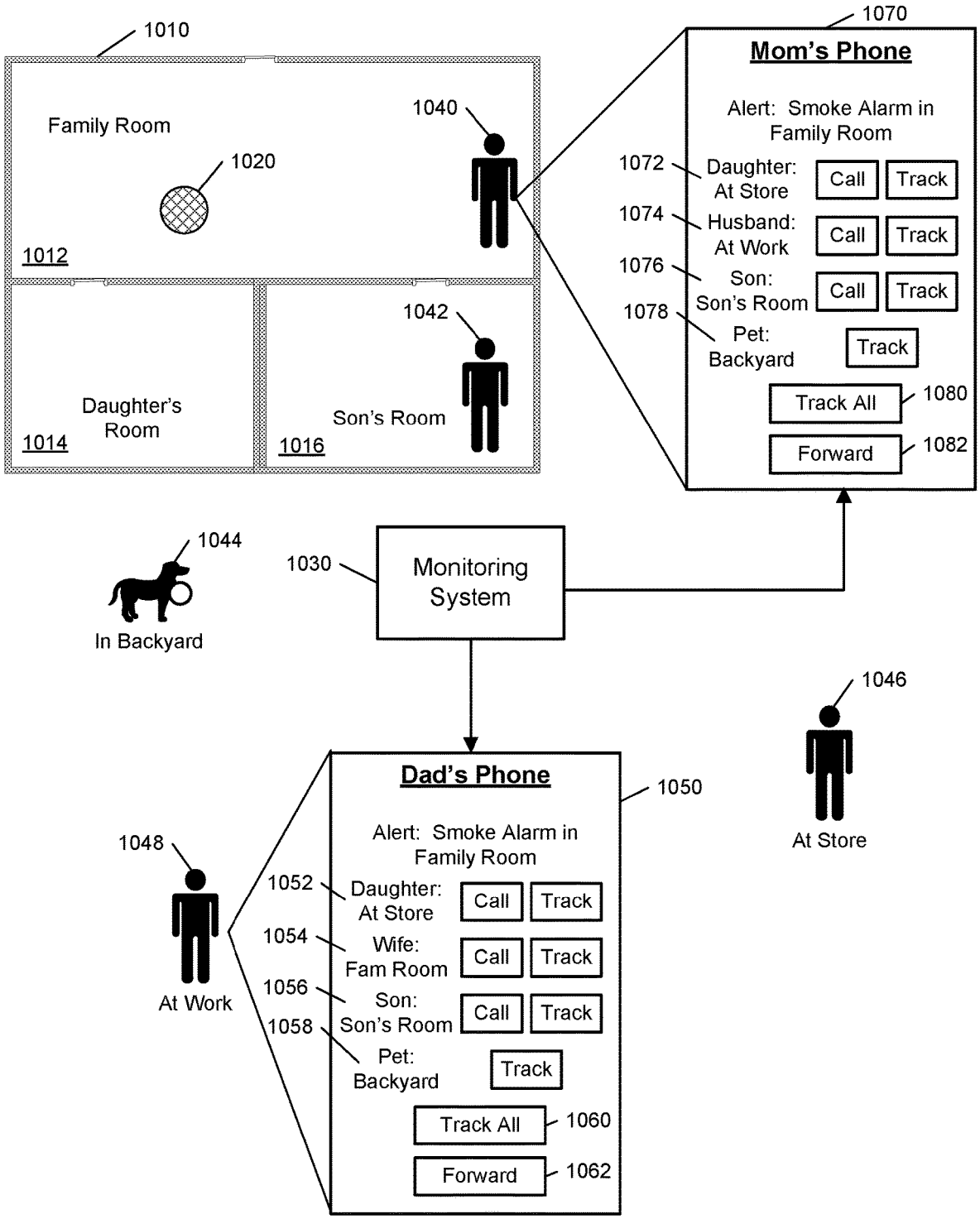
FIGS. 10-13 illustrate examples of controlling a monitoring system based on a detected event and accessed geographic location tracking data.

FIGS. 10-13 illustrate examples of controlling a monitoring system based on a detected event and accessed geographic location tracking data. FIG. 10 illustrates an example of providing an enhanced notification of an alarm event based on geographic location tracking data. As shown, a fixed property 1010 (e.g., a home residence) includes a family room 1012, a daughter's room 1014, and a son's room 1016. In the example shown in FIG. 10, a smoke detector 1020 that monitors smoke levels in the fixed property 1010 has detected a fire event based on measured smoke levels.

A monitoring system 1030 monitors events in the fixed property 1010 based on data from sensors that monitor attributes of the fixed property 1010. When the smoke detector 1020 detects the fire event, the monitoring system 1030 receives output from the smoke detector 1020 based on the detected fire event and the monitoring system 1030 takes appropriate action, such as notifying a fire department of the fire event.

The monitoring system 1030 also provides a notification of the fire event to one or more users associated with the property 1010. To provide an enhanced notification, the monitoring system 1030 determines a current geographic location of each of the users associated with the property 1010 based on location tracking data, such as a location-based activity profile for each of the users associated with the property 1010. In this example, the monitoring system 1030 determines that the mom 1040 is in the family room 1012, the son 1042 is in the son's room 1014, the dog 1044 is in the backyard, the daughter 1046 is at the store, and the dad 1048 is at work.

After determining the current location for each of the users associated with the property 1010, the monitoring system 1030 generates enhanced notifications of the fire event that combine data describing the fire event with the determined locations. The monitoring system 1030 generates a notification for the dad 1048 and a notification for the mom 1040.

The monitoring system sends the notification for the dad 1048 to the dad's mobile phone 1050. As shown, the notification indicates that the smoke detector 1020 in the family room 1012 has detected a smoke alarm in the family room 1012. The notification also includes a daughter portion 1052 that indicates the daughter 1046 is currently at the store and that includes a call input control that causes the dad's mobile phone 1050 to call the daughter 1046 and a track input control that causes the dad's mobile phone 1050 to initiate tracking of the location of the daughter 1046. The notification further includes a wife portion 1054 that indicates the wife 1040 is currently at in the family room 1012 and that includes a call input control that causes the dad's mobile phone 1050 to call the wife 1040 and a track input control that causes the dad's mobile phone 1050 to initiate tracking of the location of the wife 1040. In addition, the notification includes a son portion 1056 that indicates the son 1042 is currently in the son's room 1016 and that includes a call input control that causes the dad's mobile phone 1050 to call the son 1042 and a track input control that causes the dad's mobile phone 1050 to initiate tracking of the location of the son 1042. The notification includes a dog portion 1058 that indicates the dog 1044 is currently in the backyard and that includes a track input control that causes the dad's mobile phone 1050 to initiate tracking of the location of the dog 1044. The dog portion 1058 does not include a call input control because the dog 1044 does not operate a phone.

The location data included in the notification provides the dad 1048 with location information that enables the dad 1048 to quickly assess the threat posed by the fire event. In addition, the input controls enable the dad 1048 to stay in touch with the handling of the fire event by allowing the dad 1048 to track a location and/or call a user that is in a dangerous situation based on the fire event. For instance, the dad 1048 may initiate location tracking for the wife 1040 and the son 1042 and initiate a call to the daughter 1046 to alert the daughter 1046 to the fire event situation.

The notification also includes a track all input control 1060 that causes the dad's mobile phone 1050 to initiate tracking of the location of all members of the family. The notification further includes a forward input control 1062 that enables the dad 1048 to forward the notification to one or more other users. For instance, the dad 1048 may forward the notification to another family member or a neighbor to inform them of the fire event and the location of members of the family. Also, the dad 1048 may forward the notification to an emergency response unit that is responding to the fire event to assist the emergency response unit in locating family members that are still within the property 1010.

The monitoring system sends the notification for the mom 1040 to the mom's mobile phone 1070. As shown, the notification indicates that the smoke detector 1020 in the family room 1012 has detected a smoke alarm in the family room 1012. The notification also includes a daughter portion 1072 that indicates the daughter 1046 is currently at the store and that includes a call input control that causes the mom's mobile phone 1070 to call the daughter 1046 and a track input control that causes the mom's mobile phone 1070 to initiate tracking of the location of the daughter 1046. The notification further includes a husband portion 1074 that indicates the husband 1048 is currently at work and that includes a call input control that causes the mom's mobile phone 1070 to call the husband 1048 and a track input control that causes the mom's mobile phone 1070 to initiate tracking of the location of the husband 1048. In addition, the notification includes a son portion 1076 that indicates the son 1042 is currently in the son's room 1016 and that includes a call input control that causes the mom's mobile phone 1070 to call the son 1042 and a track input control that causes the mom's mobile phone 1070 to initiate tracking of the location of the son 1042. The notification includes a dog portion 1078 that indicates the dog 1044 is currently in the backyard and that includes a track input control that causes the mom's mobile phone 1070 to initiate tracking of the location of the dog 1044. The dog portion 1078 does not include a call input control because the dog 1044 does not operate a phone.

The notification also includes a track all input control 1080 that causes the mom's mobile phone 1070 to initiate tracking of the location of all members of the family. The notification further includes a forward input control 1082 that enables the mom 1040 to forward the notification to one or more other users. For instance, the mom 1040 may forward the notification to another family member or a neighbor to inform them of the fire event and the location of members of the family. The mom 1040 may forward the notification to an emergency response unit that is responding to the fire event to assist the emergency response unit in locating family members that are still within the property 1010.

Figure 11:
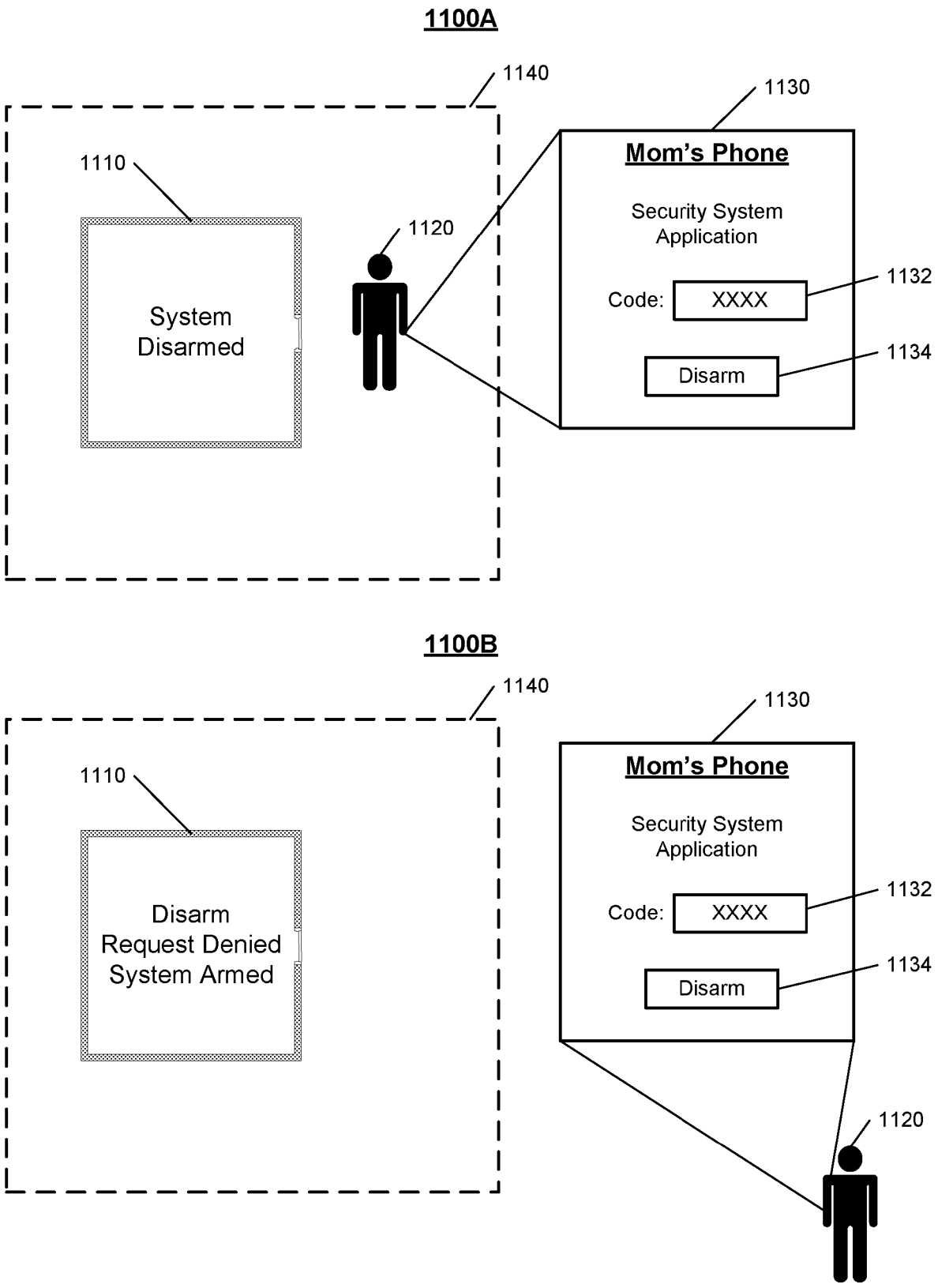

FIG. 11 illustrates examples of handling a request to perform a control operation of a monitoring system that monitors a fixed property 1110 based on geographic location tracking data. As shown, a mom 1120 controls the mom's mobile phone 1130 to operate a security system application. The security system application displays a text input box 1132 in which the mom 1120 enters a code needed to disarm a security system at the property 1110. The security system application also displays a disarm input control 1134 that causes the mom's mobile phone 1130 to transmit a disarm command to the security system based on the code entered in the text input box 1132.

In response to receiving the disarm command, the security system accesses a current geographic location of the mom's mobile phone 1130 and determines how to handle the disarm command based on the current geographic location of the mom's mobile phone 1130. For instance, the security system compares the current geographic location of the mom's mobile phone 1130 to a permissible disarm zone 1140 that is defined relatively close to the fixed property 1110. Based on the comparison, the security system determines whether the mom's mobile phone 1130 is within the permissible disarm zone 1140 and handles the disarm command accordingly.

In a first example 1100A, the mom's mobile phone 1130 is within the permissible disarm zone 1140 when the disarm command is received by the security system and, therefore, the security system grants the disarm command and disarms the security system. In a second example 1100B, the mom's mobile phone 1130 is outside the permissible disarm zone 1140 when the disarm command is received by the security system and, therefore, the security system denies the disarm command. In denying the disarm command, the security system maintains the security system in an armed state and sends a message to the mom's mobile phone 1130 to indicate that the disarm command has been denied because the mom's mobile phone 1130 is too far away from the property 1110.

Figure 12:
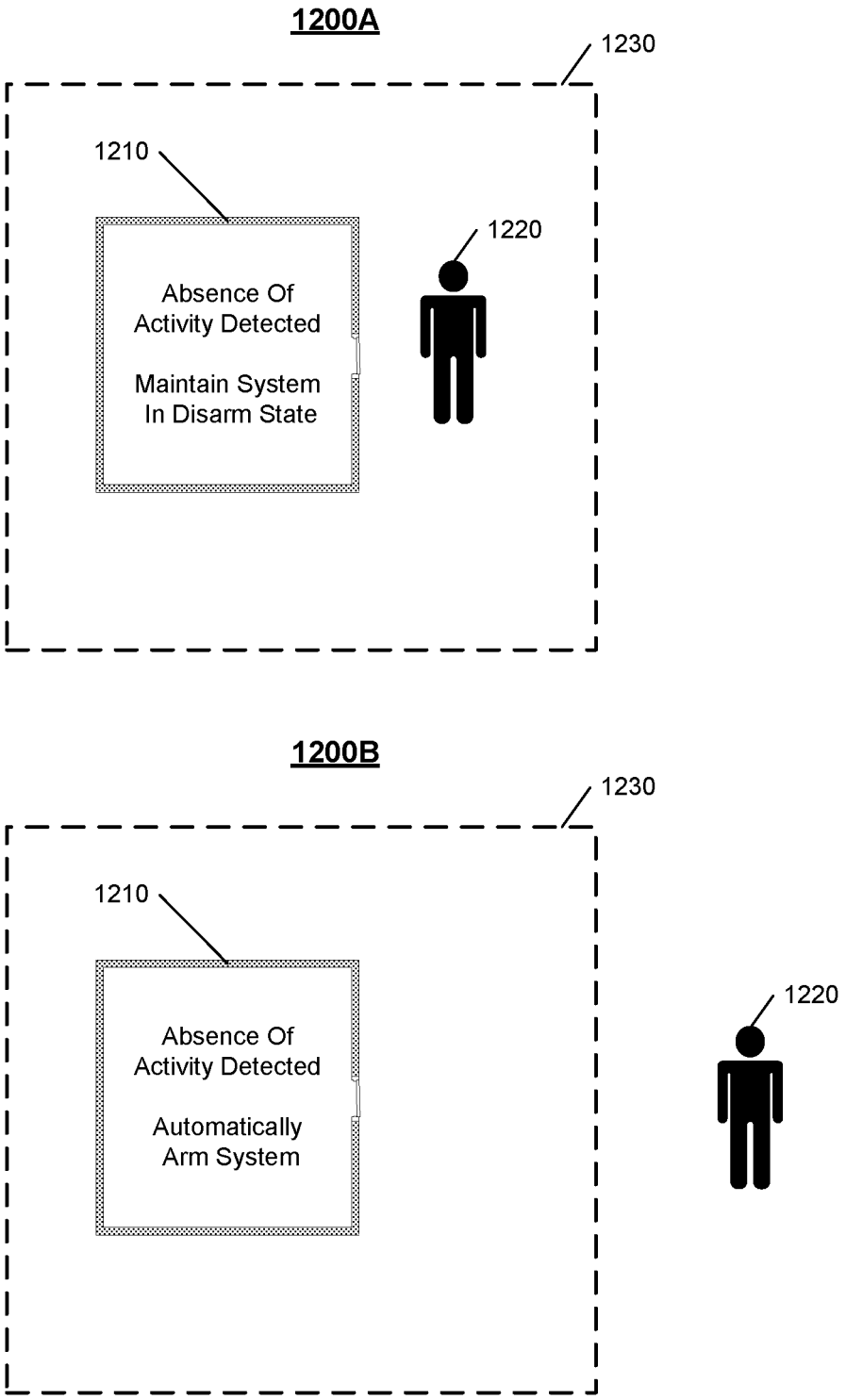

FIG. 12 illustrates examples of handling an automatic control operation of a monitoring system that monitors a fixed property 1210 based on geographic location tracking data. As shown, a security system that monitors the property 1210 detects an absence of activity within the property 1210 for a threshold amount of time while the security system is in a disarmed state. Based on detecting the absence of activity within the property 1210 for the threshold amount of time while the security system is in the disarmed state, the security system initiates a process to determine whether to automatically, without human intervention, arm the security system.

To make the determination of whether to automatically arm the security system, the security system determines, based on geographic location tracking data, a current geographic location for all users associated with the property 1210 and determines whether any of the users associated with the property 1210 are within an automatic arming decision zone 1230 when the absence of activity is detected.

In a first example 1200A, a user 1220 is detected as being within the automatic arming decision zone 1230 when the absence of activity is detected. Therefore, the security system does not automatically arm the security system and maintains the security system in a disarmed state. The security system may not automatically arm the security system in this example because the user 1220 is detected as being relatively close to the property 1210 and, therefore, arming of the system is likely not necessary and may be inconvenient for the user 1220. In this example, the security system may track a geographic location of the user 1220 and, if the user 1220 moves outside of the automatic arming decision zone 1230, the security system may automatically arm the security system at that time.

In a second example 1200B, the user 1220 is detected as being outside of the automatic arming decision zone 1230 when the absence of activity is detected. Therefore, the security system automatically arms the security system. The security system may automatically arm the security system in this example because the user 1220 is detected as being relatively far from the property 1210 and, therefore, arming of the system is likely beneficial to the user 1220.

Figure 13:
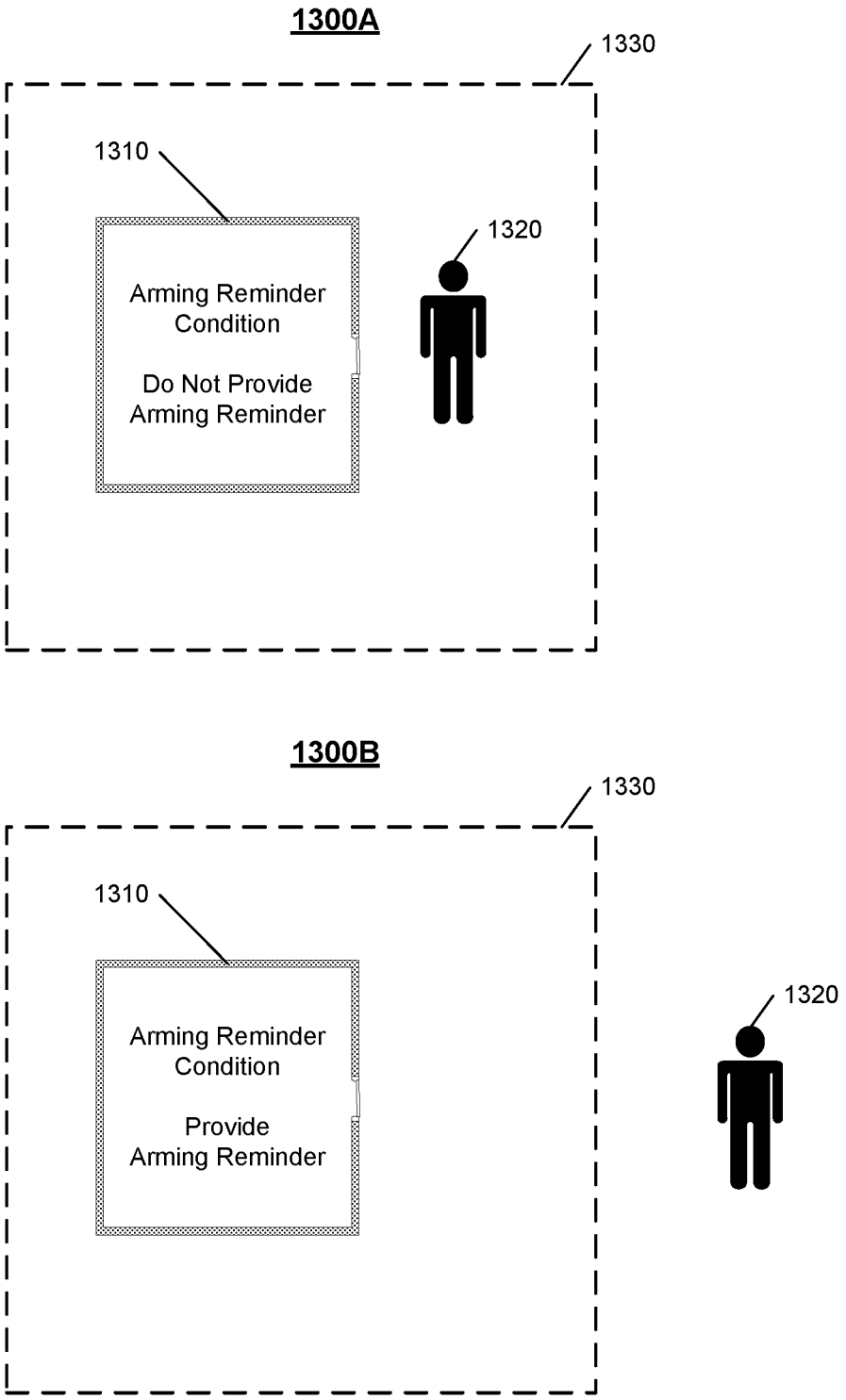

FIG. 13 illustrates examples of handling a notification of a monitoring system that monitors a fixed property 1310 based on geographic location tracking data. As shown, a security system that monitors the property 1310 detects an arming reminder condition based on a time of day and/or activity within the property 1310. Based on detecting the arming reminder condition, the security system initiates a process to determine whether to provide the arming reminder.

To make the determination of whether to provide the arming reminder, the security system determines, based on geographic location tracking data, a current geographic location for all users associated with the property 1310 and determines whether any of the users associated with the property 1310 are within an arming reminder decision zone 1330 when the arming reminder condition is detected.

In a first example 1300A, a user 1320 is detected as being within the arming reminder decision zone 1330 when the arming reminder condition is detected. Therefore, the security system does not provide the arming reminder. The security system may not provide the arming reminder in this example because the user 1320 is detected as being relatively close to the property 1310 and, therefore, the arming reminder is likely not necessary and may be inconvenient for the user 1320. In this example, the security system may track a geographic location of the user 1320 and, if the user 1320 moves outside of the arming reminder decision zone 1330, the security system may provide the arming reminder at that time.

In a second example 1300B, the user 1320 is detected as being outside of the arming reminder decision zone 1330 when the arming reminder condition is detected. Therefore, the security system provides the arming reminder. The security system may provide the arming reminder in this example because the user 1320 is detected as being relatively far from the property 1310 and, therefore, the arming reminder is likely beneficial to the user 1320.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially-designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A system for monitoring a fixed property, the system comprising:

a fixed sensor that is located at the fixed property and that is configured to generate fixed sensor data that reflects an attribute of the fixed property;

a mobile sensor that is configured to generate mobile sensor data that reflects a location of a mobile asset;

an additional mobile sensor that is configured to generate additional mobile sensor data that reflects a location of an additional mobile asset; and a monitor control unit that is configured to:

receive, from the fixed sensor, the fixed sensor data;

based on the fixed sensor data, determine that an event has occurred at the fixed property and that a resident is located at the fixed property;

determine that the mobile asset is associated with the event;

based on the mobile asset being associated with the event, select, from among multiple periodic frequencies, a periodic frequency for the mobile sensor to transmit the mobile sensor data;

based on the resident being located at the fixed property, select, from among multiple tracking scales, a tracking scale for the mobile sensor to generate the mobile sensor data;

transmit, to the mobile sensor, instructions to generate the mobile sensor data at the selected tracking scale and transmit the mobile sensor data at the selected periodic frequency;

receive, from the fixed sensor, additional fixed sensor data;

based on the additional fixed sensor data, determine that the event continues to occur at the fixed property and that the resident is away from the fixed property;

determine that the additional mobile asset is not associated with the event;

based on the additional mobile asset not being associated with the event, select, from among the multiple periodic frequencies, an additional periodic frequency for the additional mobile sensor to transmit the additional mobile sensor data;

based on the resident being away from the fixed property, select, from among the multiple tracking scales, an additional tracking scale for the additional mobile sensor to generate the additional mobile sensor data; and transmit, to the additional mobile sensor, additional instructions to generate the additional mobile sensor data at the selected additional tracking scale and transmit the additional mobile sensor data at the selected additional periodic frequency.

2. The system of claim 1, wherein the monitor control unit is configured to:

identify a geofence around the property associated with the event;

receive, from the mobile sensor at the selected periodic frequency, additional mobile sensor data collected according to the selecting tracking scale;

based on the additional mobile sensor data collected according to the selecting tracking scale, determine that the mobile asset is outside of the geofence; and based on determining that the mobile asset is outside of the geofence, transmit a notification to a user associated with the mobile asset indicating mobile asset is outside the geofence.

3. The system of claim 2, wherein the geofence is configured to change based on a time of day.

4. The system of claim 1, wherein the selected tracking scale is finer than the selected additional tracking scale.

5. The system of claim 1, wherein the selected periodic frequency is greater than the selected additional periodic frequency.

6. The system of claim 1, wherein the mobile asset is the resident.

7. The system of claim 1, wherein the mobile asset is a person, a pet, or an object.

8. A computer-implemented method, comprising:

receiving, from a fixed sensor that is located at a property and by a monitoring system that is configured to monitor the property, fixed sensor data that reflects an attribute of the fixed property;

based on the fixed sensor data, determining, by the monitoring system, that an event has occurred at the fixed property and that a resident is located at the fixed property;

determining, by the monitoring system, that a mobile asset is associated with the event;

based on the mobile asset being associated with the event, selecting, by the monitoring system and from among multiple periodic frequencies, a periodic frequency for a mobile sensor to transmit mobile sensor data that reflects a location of the mobile asset;

based on the resident being located at the fixed property, selecting, by the monitoring system and from among multiple tracking scales, a tracking scale for the mobile sensor to generate the mobile sensor data;

transmitting, by the monitoring system and to the mobile sensor, instructions to generate the mobile sensor data at the selected tracking scale and transmit the mobile sensor data at the selected periodic frequency;

receiving, by the monitoring system and from the fixed sensor, additional fixed sensor data;

based on the additional fixed sensor data, determining, by the monitoring system, that the event continues to occur at the fixed property and that the resident is away from the fixed property;

determining, by the monitoring system, that the additional mobile asset is not associated with the event;

based on the additional mobile asset not being associated with the event, selecting, by the monitoring system and from among the multiple periodic frequencies, an additional periodic frequency for an additional mobile sensor to transmit additional mobile sensor data that reflects a location of the additional mobile asset;

based on the resident being away from the fixed property, selecting, by the monitoring system and from among the multiple tracking scales, an additional tracking scale for the additional mobile sensor to generate the additional mobile sensor data; and transmitting, by the monitoring system and to the additional mobile sensor, additional instructions to generate the additional mobile sensor data at the selected additional tracking scale and transmit the additional mobile sensor data at the selected additional periodic frequency.

9. The method of claim 8, comprising:

identifying, by the monitoring system, a geofence around the property associated with the event;

receiving, by the monitoring system and from the mobile sensor at the selected periodic frequency, additional mobile sensor data collected according to the selecting tracking scale;

based on the additional mobile sensor data collected according to the selecting tracking scale, determining, by the monitoring system, that the mobile asset is outside of the geofence; and based on determining that the mobile asset is outside of the geofence, transmitting, by the monitoring system, a notification to a user associated with the mobile asset indicating mobile asset is outside the geofence.

10. The method of claim 9, wherein the geofence is configured to change based on a time of day.

11. The method of claim 8, wherein the selected tracking scale is finer than the selected additional tracking scale.

12. The method of claim 8, wherein the selected periodic frequency is greater than the selected additional periodic frequency.

13. The method of claim 8, wherein the mobile asset is the resident.

14. The system of claim 8, wherein the mobile asset is a person, a pet, or an object.

15. One or more non-transitory computer-readable storage medium comprising instructions, which, when executed by one or more computing devices, cause the one or more computing devices to perform operations comprising:

receiving, from a fixed sensor that is located at a property and by a monitoring system that is configured to monitor the property, fixed sensor data that reflects an attribute of the fixed property;

based on the fixed sensor data, determining, by the monitoring system, that an event has occurred at the fixed property and that a resident is located at the fixed property;

determining, by the monitoring system, that a mobile asset is associated with the event;

based on the mobile asset being associated with the event, selecting, by the monitoring system and from among multiple periodic frequencies, a periodic frequency for a mobile sensor to transmit mobile sensor data that reflects a location of the mobile asset;

based on the resident being located at the fixed property, selecting, by the monitoring system and from among multiple tracking scales, a tracking scale for the mobile sensor to generate the mobile sensor data;

transmitting, by the monitoring system and to the mobile sensor, instructions to generate the mobile sensor data at the selected tracking scale and transmit the mobile sensor data at the selected periodic frequency;

receiving, by the monitoring system and from the fixed sensor, additional fixed sensor data;

based on the additional fixed sensor data, determining, by the monitoring system, that the event continues to occur at the fixed property and that the resident is away from the fixed property;

determining, by the monitoring system, that the additional mobile asset is not associated with the event;

based on the additional mobile asset not being associated with the event, selecting, by the monitoring system and from among the multiple periodic frequencies, an additional periodic frequency for an additional mobile sensor to transmit additional mobile sensor data that reflects a location of the additional mobile asset;

based on the resident being away from the fixed property, selecting, by the monitoring system and from among the multiple tracking scales, an additional tracking scale for the additional mobile sensor to generate the additional mobile sensor data; and transmitting, by the monitoring system and to the additional mobile sensor, additional instructions to generate the additional mobile sensor data at the selected additional tracking scale and transmit the additional mobile sensor data at the selected additional periodic frequency.

16. The medium of claim 15, wherein the operations comprise:

identifying, by the monitoring system, a geofence around the property associated with the event;

receiving, by the monitoring system and from the mobile sensor at the selected periodic frequency, additional mobile sensor data collected according to the selecting tracking scale;

based on the additional mobile sensor data collected according to the selecting tracking scale, determining, by the monitoring system, that the additional mobile asset is outside of the geofence; and based on determining that the additional mobile asset is outside of the geofence, transmitting, by the monitoring system, a notification to a user associated with the mobile asset indicating mobile asset is outside the geofence.

17. The medium of claim 16, wherein the geofence is configured to change based on a time of day.

18. The medium of claim 15, wherein the selected tracking scale is finer than the selected additional tracking scale.

19. The medium of claim 15, wherein the selected periodic frequency is greater than the selected additional periodic frequency.

* * * * *